US012635767B2

(12) United States Patent
Paterson et al.

(10) Patent No.: US 12,635,767 B2
(45) Date of Patent: May 26, 2026

(54) SHOE WITH A COMBINATION OF LIGHTWEIGHT UPPER CONSTRUCTION

(71) Applicant: adidas AG, Herzogenaurach (DE)

(72) Inventors: Robbie Paterson, Nuremberg (DE); Valentin Perrin, Nuremberg (DE); Falk Bruns, Nuremberg (DE); Takashi Azuma, Herzogenaurach (DE)

(73) Assignee: adidas AG, Herzogenaurach (DE)

( * ) Notice: Subject to any disclaimer, the term of this patent is extended or adjusted under 35 U.S.C. 154(b) by 77 days.

(21) Appl. No.: 18/311,091

(22) Filed: May 2, 2023

(65) Prior Publication Data

US 2023/0346079 A1 Nov. 2, 2023

(30) Foreign Application Priority Data

May 2, 2022 (DE) ..... 10 2022 001 531.5

(51) Int. Cl.
*A43B 23/02* (2006.01)
*A43D 86/00* (2006.01)
(Continued)

(52) U.S. Cl.
CPC ..... *A43B 23/025* (2013.01); *A43B 23/0255* (2013.01); *A43D 86/00* (2013.01);
(Continued)

(58) Field of Classification Search
CPC . A43B 23/025; A43B 23/027; A43B 23/0295; A43B 23/04; A43B 23/042; A43B 3/14; A43B 13/38
(Continued)

(56) References Cited

U.S. PATENT DOCUMENTS 1,178 A * 6/1839 Keen ..... A43B 3/14 36/11
95,951 A * 10/1869 Swarts ..... A43B 3/14 36/11
(Continued)

FOREIGN PATENT DOCUMENTS

EP 1880622 A1 1/2008
FR 2744342 A1 8/1997
(Continued)

OTHER PUBLICATIONS

Japanese Office Action for Japanese Application No. 2023070066, mailed Apr. 2, 2024, 14 Pages.
(Continued)

*Primary Examiner* — Khoa D Huynh
*Assistant Examiner* — Giao Qt Hoang
(74) *Attorney, Agent, or Firm* — Kilpatrick Townsend & Stockton LLP

(57) ABSTRACT

The present invention relates to a shoe upper which comprises first and second upper elements that are joined to form a foot-receiving chamber for accommodating a foot of a wearer, wherein the second upper element forms a footbed and wherein the second upper element comprises at least a first set of wings protruding from the lateral and medial sides of the second upper element, wherein the first set of wings comprise a first merging area configured to attach the first upper element to the second upper element.

19 Claims, 15 Drawing Sheets

(51) Int. Cl.
*A43B 3/14* (2006.01)
*A43B 13/38* (2006.01)
*A43B 23/04* (2006.01)

(52) U.S. Cl.
CPC ..... *A43B 3/14* (2013.01); *A43B 13/38* (2013.01); *A43B 23/027* (2013.01); *A43B 23/0295* (2013.01); *A43B 23/04* (2013.01)

(58) Field of Classification Search
USPC ..... 36/47–49
See application file for complete search history.

(56) References Cited

U.S. PATENT DOCUMENTS 203,851 A * 5/1878 Pitts ..... A43B 3/14 36/11
D18,938 S * 2/1889 Hamilton ..... D2/935
1,251,966 A * 1/1918 Conte ..... A43B 23/02 36/48
2,340,578 A * 2/1944 Cairns ..... A43B 1/05 36/9 R
2,425,955 A * 8/1947 Rouch ..... A43B 23/0295 36/52
2,513,005 A * 6/1950 Crawford ..... A43B 3/12 D2/919
2,552,802 A * 5/1951 Martin ..... A41D 10/00 36/47
2,645,042 A * 7/1953 Stritter ..... A43B 3/14 36/11
2,738,527 A * 3/1956 Weiss ..... A43B 3/14 36/11
2,748,501 A * 6/1956 Martin ..... A43C 11/004 36/11
3,710,485 A * 1/1973 Irwin ..... A43B 3/106 36/11
3,813,719 A * 6/1974 Kaschura ..... A43B 13/28 12/142 RS
4,136,468 A * 1/1979 Munschy ..... A43B 3/26 36/97
4,149,323 A * 4/1979 Roy ..... A43B 23/0295 36/48
4,481,725 A * 11/1984 Bergmans ..... A43B 3/14 36/11
5,345,638 A * 9/1994 Nishida ..... A43B 23/042 36/45
5,604,997 A * 2/1997 Dieter ..... A43B 23/042 36/47
6,558,784 B1 * 5/2003 Norton ..... A43B 5/002 36/49
8,042,288 B2 10/2011 Bhupesh et al.
8,321,984 B2 * 12/2012 Dojan ..... B29D 35/148 12/142 R
8,429,835 B2 * 4/2013 Dojan ..... A43B 23/026 36/3 R
8,434,245 B2 * 5/2013 Bell ..... A43B 9/00 36/105
9,038,287 B2 * 5/2015 Bell ..... A43B 13/22 36/83
10,548,364 B2 * 2/2020 Podhajny ..... A43B 23/042
11,672,307 B2 * 6/2023 Kilgore ..... A43B 23/025 36/49
2004/0111921 A1 6/2004 Lenormand
2008/0040950 A1 * 2/2008 Mariacher ..... A43B 3/0052 36/25 R
2008/0250668 A1 * 10/2008 Marvin ..... A43B 23/0255 36/50.1
2010/0269372 A1 * 10/2010 Dua ..... A43B 23/0275 36/47
2010/0325916 A1 * 12/2010 Dua ..... A43B 23/0275 36/47
2011/0107620 A1 * 5/2011 Bell ..... A43B 23/026 36/83
2011/0247239 A1 * 10/2011 Berend ..... A43B 13/188 36/105
2011/0277349 A1 * 11/2011 Kim ..... A43D 111/00 12/146 C
2012/0066931 A1 * 3/2012 Dojan ..... A43B 23/0225 36/83
2012/0144698 A1 * 6/2012 McDowell ..... B29C 70/42 36/45
2012/0204445 A1 * 8/2012 Karandonis ..... A43C 11/12 36/83
2013/0025157 A1 * 1/2013 Wan ..... A43B 7/06 36/45
2015/0068061 A1 * 3/2015 Farris ..... A43C 5/00 36/83
2015/0143716 A1 * 5/2015 Long ..... A43B 1/04 36/83
2015/0223554 A1 * 8/2015 Ardell ..... A43C 15/005 36/105
2015/0289592 A1 * 10/2015 Song ..... A43B 23/0245 36/47
2017/0360140 A1 * 12/2017 Siegismund ..... A43B 23/042
2019/0037959 A1 * 2/2019 Berrian ..... A43B 23/0245
2019/0208862 A1 * 7/2019 Poegl ..... A43B 23/025
2019/0223545 A1 * 7/2019 Chang ..... A43B 23/042
2019/0313728 A1 * 10/2019 Berrian ..... A43B 23/042
2020/0138143 A1 * 5/2020 Stirling ..... A43D 8/26
2020/0315296 A1 * 10/2020 Giorgini ..... D04B 1/22
2021/0022432 A1 * 1/2021 Tapper ..... A61N 5/0622
2021/0251340 A1 * 8/2021 Rodriguez ..... A43B 23/0235
2021/0330035 A1 * 10/2021 Blondeau ..... A43B 3/126
2022/0142293 A1 * 5/2022 Tapper ..... A61N 5/0622
2023/0098661 A1 * 3/2023 Suzuki ..... A43B 1/05 36/55
2023/0109289 A1 * 4/2023 Suzuki ..... A43B 1/04 36/45

FOREIGN PATENT DOCUMENTS

FR 2848390 A1 6/2004
JP 2013-516247 A 5/2013
WO 2011/082391 A1 7/2011

OTHER PUBLICATIONS

Extended European Search Report for European Application No. EP 23169483, dated Aug. 29, 2023, 8 Pages.
First Office Action for German Application No. 10 2022 001 531.5, dated Dec. 7, 2022, 12 Pages.
Japanese Office Action, English Translation.
JP 2013-516247 A, English Abstract and English Equivalent Pub. No. WO 2011/082391 A1.

* cited by examiner

SHOE WITH A COMBINATION OF LIGHTWEIGHT UPPER CONSTRUCTION

CROSS-REFERENCE TO RELATED APPLICATIONS

This application claims foreign priority benefits under 35 U.S.C. § 119(a)-(d) to German patent application number DE 10 2022 001 531.5, filed May 2, 2022, which is incorporated by reference in its entirety.

TECHNICAL FIELD

The present invention generally relates to a shoe upper, a shoe comprising a shoe upper and a method for manufacturing the shoe upper.

BACKGROUND

Modern shoes may be made from a plurality of individual parts, these individual components are then combined together in a series of manufacturing steps to create a final shoe. One such are of combination is combining the upper to create a foot receiving space. In a conventional sports shoe, this is achieved using a Strobel arrangement. A strobel arrangement is when the upper component of a shoe, sometimes known as the vamp, is attached to a further component, the strobel. The Strobel then forms part of the footbed on which the wearer may step during walking thereby creating a foot-receiving space. One disadvantage of the Strobel arrangement is that the seam inside the shoe may cause irritations to the foot or worse lead to blisters. To avoid skin irritations the shoe upper is provided with a sock-like arrangement (e.g., a sockliner) in the interior of the shoe upper for cushioning purposes and hence, more comfort for the wearer.

However, another disadvantage of the Strobel arrangement is that using additional components increases the weight of the construction. One such additional component is that a Strobel construction also typically involves the use of a sockliner to avoid aforesaid disadvantage of the seam irritating the foot of the wearer.

Moccasin shoes known in the art are lightweight shoes that consists of upper, quarters and insoles all stitched together in one piece. Thus, the Moccasin construction does not use a Strobel alignment and a sockliner.

However, moccasins are not suitable for athletic activities as they do not provide sufficient tightness and stability, which is required for athletic activities.

U.S. Pat. No. 8,042,288 B2 relates to an article of footwear and a method of manufacturing the article of footwear. The footwear may include an upper and a sole structure. The upper incorporates a textile element with edges that are joined together to define at least a portion of a void for receiving a foot.

U.S. Pat. No. 10,548,364 B2 relates to an article of footwear which includes an upper with a knitted component formed of a unitary knit construction.

The shoe uppers of the prior art are either not lightweight, do not provide sufficient stability or are not comfortable enough for athletic activities. The upper either fits tightly but uncomfortably or is comfortable but loose. In the case of a sports shoe this may lead to a lack of control of the foot movements, for example, when sprinting or performing rapid changes of directions.

The weight of athletic shoes may influence the speed and performance of an athlete, because heavier shoes require an increased energy input from the user to move the larger weight. It is well known that seconds may be crucial in the athletic world. Therefore, increasing speed and performance is desired. This is achieved by a lightweight shoe. At the same time, it is required to provide a lightweight shoe that is comfortable and flexible but also provides sufficient stability for high performance.

Hence, a shoe upper for athletic shoes is required, which overcomes the above-mentioned drawbacks of the moccasin construction and the conventional athletic shoes.

It is therefore the object of the present invention to provide a lightweight shoe upper that is comfortable and flexible and still provides the required stability that can easily be manufactured in a sustainable way.

This is achieved by the shoe upper according to claim 1, the shoe according to claim X and the method of manufacturing a shoe upper according to claim Y.

SUMMARY OF THE INVENTION

According to a first aspect of the present invention, these problems are at least partially solved by a shoe upper, which may comprise first and second upper elements which may be joined to form a foot-receiving chamber for accommodating a foot of a wearer. The second upper element may form the footbed and the second upper element may comprise at least a first set of wings protruding from the lateral and medial sides of the second upper element, wherein the first set of wings may comprise a first merging area configured to attach the first upper element to the second upper element.

The shoe upper may at least comprise two elements, the first upper element and the second upper element. The first upper element may be located an upper side of the shoe upper whereas the second upper element may be located on a bottom side of the shoe upper. An upper side in this context may be understood to be the side of the shoe upper which is farthest from the ground and the bottom face/side of the shoe upper may be understood to be the side of the shoe upper closest to the ground.

In its function as the bottom element, a wearer of the shoe upper may step on at least a portion of the second upper element when wearing the shoe upper.

The lateral and medial sides may be understood as a left side and a right side of the second upper element, as seen from a top-view onto the second upper element, and may be understood as the medial (facing towards a center of a body of the wearer) and lateral (facing away from the body of the wearer) sides of the shoe upper.

The first set of wings may preferably comprise two (distinct) wings. In some exemplary embodiments, it may also be possible that the first set of wings comprise three, four, five, six, etc. (distinct) wings.

The first merging area may preferably be located on a medial and/or a lateral side of the (assembled) shoe upper. The first merging area may preferably extend from a medial and/or a lateral side of the shoe upper, from a bottom side of the shoe upper (e.g., from a lateral/medial area which, in an assembled shoe upper, may be close to a ball area of the foot of the wearer), across a malleolar region of the foot of the wearer of the shoe upper up to the upper heel area of the shoe upper. A heel area may relate to an area of the shoe upper at which an Achilles' heel of the foot of the wearer may be located.

By assembling the shoe upper based at least in part on joining together the first upper element and the second upper element, a precise definition of the shape of the shoe upper may be facilitated. By joining together the first upper element and the second upper element by means of the respective wings and the respective merging areas, a tighter fit of the shoe upper to the foot of the wearer may be facilitated. This may be facilitated by the respective first upper element and second upper element being closer and tighter together (as a result of the joining) than they would be if they were closed via being tied together with laces, for example, in a shoe upper known in the art. This may allow to prevent undesired space between the shoe upper and the foot of the wearer. Therefore, undesired slack of the foot of the wearer relative to the shoe upper (e.g., in a lateral malleolar region of the foot of the wearer) may be suppressed. In athletic performance, the 'looseness' of the shoe upper can have detrimental effects due to energy losses and a perceived lack of stability by the wearer. This perceived, or actual, lack of stability can translate into increased (and undesired) muscle activation of the wearer as they seek to stabilize the foot and ankle which causes undue fatigue in the lower leg muscles, which in athletic applications, may lead to a performance loss for the athlete as at least part of the motional energy may be transformed into the slack and may thus not be fully provided for the athletic application anymore. A further advantage of the inventive shoe upper may arise from the aspect that any merging areas, at which the first upper element may be joined together with the second upper element, may be located on a lateral and/or medial side of the shoe upper and not on the footbed. Therefore, the wearer of the shoe upper may not step onto the respective merging areas, which may lead to an undesired discomfort. Therefore, no longer requires a sockliner to cover the stitch lines as in a conventional Strobel shoe arrangement. The absence of a sockliner may further lead to a weight reduction of the shoe upper and may thus contribute to an increased performance of an athlete as any shoe-weight-related contribution to fatigue of the athlete may be minimized. Moreover, a design of the shoe upper as mentioned above may also allow the manufacturing of a shoe upper without a heel counter which may contribute to a further weight reduction of the shoe upper.

A further advantage of the inventive shoe upper can be seen in an improved recyclability of the shoe upper as a less complex shoe upper is provided which in turn reduces required recycling efforts.

The first set of wings may further comprise second merging areas, located at an outer edge of the first set of wings extending from the ball area to the heel area.

The outer edge may be located in an area of the shoe upper which is close to the bottom side of the shoe upper. Close in this context may be understood such that the outer edge may be distanced from the bottom side of the shoe upper by, e.g., less than 2 mm, less than 3 mm, less than 5 mm, less than 10 mm, less than 15 mm or less than 20 mm.

By arranging the second merging areas such that that they extend along an outer edge on the right side of the shoe upper and on the outer edge on the left side of the shoe upper, it may be facilitated that also the respective area in the vamp portion of the shoe upper may be provided with means for more precisely defining the shape of the shoe upper in at least said areas which may contribute to a suppression of undesired slack of the foot of the wearer. In other words, by providing the shoe upper with the second merging areas, a tighter fit of the shoe upper in at least the second merging areas may be facilitated. This allows a tighter fit of the shoe upper in said areas and may thus provide increased performance support for an athlete as outlined above.

The first set of wings of the second upper element may extend beyond a heel area located on the second upper element in a longitudinal direction of the second upper element in an uncoupled state; wherein, in a coupled state, the first set of wings may form the heel area of the shoe upper.

The uncoupled state may refer to a non-assembled state of the shoe upper. In the aforementioned (uncoupled) state, as seen from a top-view, the wings of the first set of wings of the second upper element may extend beyond the heel area (i.e., the area of the second upper element at which a heel of the foot of the wearer may be located in a state in which the shoe upper is assembled).

When joining together a first wing located on a left side of the second upper element with a second wing located on a right side of the second upper element, a heel area of the shoe upper may be formed. The heel area may be adapted to support the heel (e.g., the Achilles's heel of the foot of the wearer) and may fully encompass the heel of the foot of the wearer when the shoe upper is worn.

Such a configuration may allow for a simplified and faster manufacturing of the shoe upper. In particular, less components need to be assembled and joined together as at least the wings of the first set of wings may already be part of the second upper element. The heel area may further be adapted such that a tight fit to the heel of the foot of the wearer may be facilitated.

The second upper element may further comprise at least a second set of wings which may protrude opposing sides of the second upper element.

The second set of wings may preferably comprise two (distinct) wings. In some exemplary embodiments, it may also be possible that the first set of wings comprise three, four, five, six, etc. (distinct) wings.

If the second set of (e.g., two) wings is distinct from the first set of wings, there may be no connection between the wings of the first set of wings and the wings of the second set of wings besides by means of the second upper element.

A distinct arrangement of the second set of wings may provide an independent adjustment of the shape of the assembled shoe upper to the shape of the foot of the wearer, in an area in which the second set of wings is located, independent from the adaption of the shape of the shoe upper to the foot of the wearer in the area of the first set of wings of the second upper element. Therefore, additional degrees of freedom may be provided for an enhanced adaption of the shoe upper to the shape of the foot of the wearer.

However, in some implementations, a wing of the first set of wings and a wing of a second set of wings, located on a respective same side of the second upper element, may additionally be connected by a respective connection element. In some cases, the connection element may be adapted such that the wing of the first set of wings and the wing of the second set of wings is integrally connected. In some implementations, the connection element may be made from, e.g., a stripe of fabric, mesh, TPU, etc. In some cases, the connection element may be made from the same material as the second upper element.

The second set of wings may be located in a toe area of the shoe upper.

The toe area of the shoe upper may relate to an area of the shoe upper which may accommodate the toes of the foot of the wearer when the shoe upper is worn.

By locating the second set of wings in a toe area of the shoe upper, an enhanced adaption of the shape of the shoe upper to the shape of the foot of the wearer in said region may be facilitated- and independent from the heel area. Moreover, since the second set of wings may be located on a lateral side of the shoe upper, any discomfort, which may arise from the presence of a merging area in the toe area on a bottom side of the shoe upper, may be prevented.

The first set of wings and/or the second set of wings may be integrally formed with the footbed of the second upper element.

An integral formation of the wings of the first set of wings and/or the wings of the second set of wings with the footbed of the second upper element may be understood such that the integrally formed wings and the footbed are provided as a single element. A single element may relate to an implementation in which the second upper element may be obtained by cutting the second upper elements from one or more layers of stacked fabric such that the respective wings are integrally connected to the footbed of the second upper element and do not require any (additional) attachment procedures. In some cases, the wings of the first set of wings and/or the second set of wings may be molded together with the footbed.

However, in some implementations it may also be possible that the footbed and one or more of the wings are obtained/manufactured independently from each other and are then integrally joined together in a subsequent manufacturing step such that the second upper element is obtained. Integrally joining the respective wings together with the footbed may comprise one or more of sewing, welding, gluing, etc.

It may be possible that both wings of the first set of wings and/or both wings of the second set of wings are integrally formed with the footbed. However, in some embodiments, it may also be possible that only one wing of the first set of wings and/or only one wing of the second set of wings is integrally formed with the footbed.

In any case, by providing the wings integrally formed (irrespective of the total number of integrally formed wings) with the footbed, a simplification of the manufacturing procedure of the shoe upper may be facilitated as the labor-intensive process of attaching one or more wings to the footbed may be rendered obsolete. This may also lead to a reduction of the overall production costs of the shoe upper.

The second set of wings may further comprise a third merging area which may be located on an outer edge of the second set of wings extending from the toe area to the ball area.

The third merging area may allow for joining the wings of the second set of wings to the first upper element, i.e., the upper side of the shoe upper.

In a preferred implementation, the third merging area may be located on a lateral and/or a front side of the shoe upper. A front side may, e.g., refer to the tip-most portion of the shoe upper (in which the toes of the foot of the wearer may be located when the shoe upper is worn). In some implementations, the third merging area may (at least partially) be located in the toe area on an upper side of the shoe upper.

By providing the third merging area on a lateral and/or an upper side of the shoe upper, it may be prevented that the wearer of the shoe upper may be perceive any discomfort when wearing the shoe upper which may arise from stepping onto the third merging area. Such an implementation may contribute to rendering a Strobel and/or any other cushioning material obsolete to overcome a potential discomfort arising from stepping onto the third merging area. Therefore, a weight reduction of the shoe upper may advantageously be supported which may be as large as 15-20 g as compared to similar shoes (e.g., shoes provided for similar athletic applications) known in the art.

The first upper element and the second upper element may be joined together at the first merging areas and/or at the second merging areas and/or at the third merging areas.

The first merging area and/or the second merging area and/or the third merging area may be provided in the shape of a line.

In some implementations, at least one of first, and/or second and/or third merging area is provided in the shape of a line. Such a line may relate to a merging area wherein the longitudinal extension of the merging area is substantially longer than its respective width.

A line shape may, inter alia, arise from an overlap region of the respective parts of the first upper element and the second upper element which are joined together by means of the line.

By providing at least one of the merging areas in the shape of a line, the spatial extension of the area, at which respective one or more wings of the second upper element are joined together with the first upper element, may be reduced. Therefore, the comfort of wearing the shoe may be improved. Moreover, since a line may only relate to an area with a minimized spatial extension, the material consumption required for joining together the first upper element and the second upper element, by means of one or more respective wings, may be reduced. This may reduce the material consumption for the production of the shoe upper (as a smaller quantity of material needs to be processed) and may generally reduce the production time as less procedural steps are required. These aforementioned aspects may further advantageously contribute to a reduction of the production costs of the shoe upper.

The first set of wings and/or the second set of wings may be arranged symmetrically relative to a centered longitudinal axis of the second upper element.

A symmetrical arrangement of the wings and/or the second set of wings may relate to an implementation in which any potential point on a wing on a, e.g., left side of the second upper element has a corresponding point on a respective wing on, e.g., a corresponding right side of the second upper element which is arranged such that each of the two corresponding points possess the same horizontal distance to the centered longitudinal axis of the second upper element.

In a preferred example, the centered longitudinal line may be arranged such that it divides the total area of the second upper element into two portions with respective equal surface areas. The centered longitudinal line may preferable extend from a toe area of the second upper element to a heel area of the second upper element and such that each selected point located on a left side of the second upper element (relative to the centered longitudinal line) has a corresponding mirroring point on a respective right side of the second upper element such that the horizontal distance of the two points to the centered longitudinal line is equal.

Such a symmetrical arrangement of the first set of wings and/or the second set of wings may simplify the geometry of parts used to manufacture the shoe upper. The advantageous usage of symmetries may lead to a reduction of the manufacturing complexity and may thus also reduce the manufacturing costs for a shoe upper.

At least one wing of the first set of wings and/or at least one wing of the second set of wings and/or the second upper element and/or the heel area may be provided with at least one reinforcing element adapted to selectively reinforce the respective first merging area and/or the second merging area and/or the third merging area.

In some cases, the first merging area and/or the second merging area and/or the third merging area may be fully provided with the reinforcement element. Alternatively, the reinforcement element may only be provided in a portion of the first merging area and/or the second merging area and/or the third merging area and may thus only selectively reinforce the first merging area and/or the second merging area and/or the third merging area.

In some implementations, also at least a portion of the respective wings, which does not contribute to the first merging area and/or the second merging area and/or the third merging area, may be provided with the reinforcement element.

The usage of a reinforcement element may, e.g., be seen as a replacement for a conventionally used heel counter (as it may provide reinforcement and stability to the heel portion of the shoe upper), however, with weight reduction. By selectively providing certain portions of the shoe upper with the reinforcement element, the overall material costs for the reinforcement element may be minimized. Moreover, under some circumstances, the processing the reinforcement element may be more cost intensive as the processing of elements different from the reinforcement element. In such cases, the selective deployment of the reinforcement may decrease the associated manufacturing costs. Therefore, the manufacturing costs may be minimized. Moreover, with a view to recyclability, a minimized usage of the reinforcement may also allow for a simplified recyclability as a decreased number of different materials need to be separated and processed.

The at least one reinforcement element may be adapted to reinforce the first set of wings and/or the second of wings and/or the second upper element and/or the first merging areas, and/or the second merging areas, and/or the third merging areas and/or the heel area.

In a preferred application, the reinforcement element may be used to provide increased stress and/or tear resistance for the first and/or the third merging area and/or the heel area.

Increased stress/tear resistance may, in particular, be seen as advantageous in said areas as, during an athletic application, increased pulling forces may act on the respective merging areas and/or the heel area which may lead to a strong load on said areas. To avoid snagging of said areas and/or any other kind of deterioration of said areas, a reinforcement element may be provided for additional resistance which may advantageously contributed to an extended lifetime of the shoe upper.

The at least one reinforcement element may be made from a thermoplastic polyurethane (TPU).

The at least one reinforcement element may be provided in the shape of a skeleton of the first upper element and/or the second upper element.

In some applications, it may also be possible that the at least one reinforcement element is not limited to merging areas and/or wings only. In some applications also at least a portion of the first upper element and/or the second upper element may be provided with a reinforcement element. Such a portion may, e.g., relate to a skeleton of the first upper element and/or the second upper element.

A skeleton may be understood as a support structure/scaffolding which may provide additional support (e.g., with a view to stiffness, rigidity, torsional stiffness, etc.) to the respective first upper element and/or the second upper element.

By providing the at least one reinforcement element in the shape of a skeleton, the overall reinforcement material consumption may be minimized. Therefore, less reinforcement material is required to provide the desired support.

The reinforcement element may be joined together with the second upper element at a bottom face of the second upper element. The reinforcement element may be provided in a shape to match the contour of the second upper element. The reinforcement element may preferably extend from the edge of the second upper element towards the center of the second upper element for not more than 15 mm.

The provided reinforcement element, preferably in the shape of a skeleton, may be joined together with the second upper element such as to form an integral unit. The reinforcement element and the second upper element may be joined together by, e.g., welding, sewing, heat pressing, gluing or a combination thereof. In some cases, the reinforcement element may also be arranged detachable from the second upper element.

In a preferred implementation, the reinforcement element may be provided in a shape such as to match the contour of the second upper element. A contour may be understood as the circumferential outer shape of, e.g., the second upper element.

Alternatively, the reinforcement element may also be provided in any other shape which may provide additional support for the reinforcement element (e.g., crossbar-shaped elements which may span across at least a portion of the second upper element, circular shaped elements, etc.).

The reinforcement element, when joined together with the second upper element, may preferably adapted to not fully cover the second upper element but may be adapted to only cover a circumferential region of the second upper element. In some cases, the reinforcement element may thus only extend from an edge of the second upper element towards the center of the second upper element by not more than 15 mm, in some cases by not more than 10 mm, in some cases by not more than 5 mm. In other applications, e.g., if increased support for the second upper element is desired, the reinforcement element may also extend by more than 15 mm towards the center of the second upper element, e.g., even by more than 20 mm, more than 30 mm, etc.

By joining together, the reinforcement element and the second upper element, the second upper element may be provided with additional support and the thus formed unit (and, in particular, the second upper element) may possess the advantages of the TPU element outlined herein.

At least one of the first upper element and/or the second upper element may be made from a substantially non-stretchable material.

A non-stretchable material may be understood as a material which does not undergo a substantial dilation as a result of applying a pulling force.

The absence of a substantial dilation in this context may be understood as a dilation which is significantly smaller than the longitudinal extension of the material in a rest state (e.g., in the absence of a pulling force). As an example, the extension in length of the respective material as a result of applying a pulling force relative to the length of the material at rest may be less than 1:100, 1:1000, 1:10000 or even less.

By providing the first upper element and/or the second upper element from a substantially non-stretchable material, a definition of the shape of the shoe upper by at least the first upper element and/or the second upper element may be facilitated and a dimensionally stable shoe upper may be achieved which may not undergo spatially deformation as a result of, e.g., a motional impact as it may occur during an athletic performance (e.g., such as running, etc.)

The first upper element and the second upper element may be joined together at least in the first merging area and/or the second merging area and/or the third merging area of the respective set of wings by stitching and/or by welding.

If the first merging area and/or the second merging area and/or the third merging area is provided in the shape of a line, the shape of a line may arise from forming of at least one of the merging areas by, e.g., stitching. In such a case, the line may essentially relate to a seam. Additionally, or alternatively, it may also be possible that the first upper element and the second upper element are joined together by means of, e.g., gluing.

By joining together, the first upper element and the second upper element by stitching and/or welding, a stable and resilient connection between the two upper elements may be formed which may be capable of withstanding potentially strong tensile forces as a result an athletic application.

The shoe upper may further comprise a longitudinal reinforcing element which may be fastened to the first upper element and/or the second upper element extending from the right lateral side of the first upper element and/or the second upper element around the heel area to the left lateral side of the first upper element and/or the second upper element and the longitudinal reinforcing element may be adapted to provide support for the heel area of the foot of the wearer.

Longitudinal in this context may be understood as referring to a reinforcing element with a substantially longer longitudinal extension as compared to its width. As an example, the longitudinal reinforcing element may possess a length which is at least twice its width. However, it may also be possible that the length is any other multiple of its width. It is further noted that the multiplicity is not limited to integer values only but may refer to any rational number.

The longitudinal reinforcing element extending around the heel area may lead to a narrowing of the heel area of the shoe upper. As a result of the narrower width of the shoe upper, the heel of the foot of the wearer may experience a tighter fit in the shoe upper which may advantageously improve the athletic performance.

The longitudinal reinforcing element may be made from an elastic material, preferably from a rubber.

In some cases, the longitudinal reinforcing element may be stretchable such that it may extend along its longitudinal extension if a polling force is acting on the reinforcing element (along its longitudinal axis).

If the longitudinal reinforcing element is made from an elastic material, the longitudinal reinforcing element may tightly adapt to the shape of the heel of the foot of the wearer and may thus provide a versatile fit for a variety of wearers with only a single shoe design. Therefore, additional wearing comfort may be provided.

The longitudinal reinforcing element may be connected with the shoe upper by gluing or welding.

In some cases, it may be possible that the longitudinal reinforcing element is connected with the shoe upper by both gluing and welding. Additionally, or alternatively, it may also be possible that the longitudinal reinforcing element is connected with the shoe upper by sewing.

By means of the aforementioned fixation techniques, it may be facilitated that the longitudinal reinforcing element is permanently connected to the shoe upper and may provide its beneficial advantages even under stress as it may occur during athletic activities.

The first upper element and/or the second upper element may be made at least partially from a sandwich mesh.

Preferably, the sandwich mesh may be adapted such that it provides increased strength, breathability, softness and cushioning and thickness for allowing for the desired cushioning properties.

In some cases, only a portion of the first upper element and/or the second upper element may be made from a sandwich mesh. Alternatively, in some exemplary cases, it may also be possible that the entire first upper element and/or the second upper element is made from a sandwich mesh.

The usage of a sandwich mesh may thus provide additional cushioning and may increase the wearing comfort of the shoe upper. Moreover, due to the additional cushioning, fatigue of the leg muscles of the athlete may be retarded. Another advantage of using a sandwich mesh may also allow for providing a shoe upper without a sockliner.

The sandwich mesh may be adapted such that a seam, arising from joining together the first upper element and the second upper element by stitching, may be located below a surface of the sandwich mesh material.

In a preferred implementation, at least the first merging area, and/or the second merging area and/or the third merging area may be made from a sandwich mesh material. The sandwich mesh material may be manufactured such that a seam, which may arise from stitching, may sink into the sandwich mesh, i.e., the seam may in some implementations not be located on the surface of the sandwich mesh.

By making at least the first merging area, and/or the second merging area and/or the third merging area from a sandwich mesh, a contact point/area of the seam with the foot of the wearer may be avoided (as the seam may reside in the sandwich mesh) and the wearing comfort of the shoe upper may advantageously be improved. Moreover, this concept further contributes to rendering a sockliner superfluous.

The shoe upper may be strobel-free.

The absence of a strobel may allow a simplified assembly process of a shoe upper, e.g., since less parts need to be assembled which may additionally reduce the manufacturing time of shoe upper. Moreover, since less parts are required for the assembly of a shoe upper, a lighter shoe upper may be manufacturable.

The first upper element may additionally be reinforced with a reinforcing element made from suede. The first upper element may preferably be reinforced in a portion of the first upper element which may form the heel area of the shoe upper.

In some applications, also other leather elements may be used as reinforcing elements in addition to or as an alternative to suede, such as, e.g., smooth leather, full-leather, etc.

Preferably, the suede may only cover a portion of the first upper element (e.g., only a heel area of the shoe upper and/or only a vamp portion of the shoe upper). In some applications the suede may be manufactured such that it is congruent with the first upper element such that it fully covers the first upper element.

By reinforcing the first upper element and/or the second upper element with suede (and/or any other leather), increased tearproof capability may be provided for these elements (especially in those areas which experience strong mechanical loads as potentially occurring during an athletic exercise). Moreover, the suede may also be used to provide the shoe upper with an optical distinction (e.g., with respect to color and/or surface structure as the suede may be provided with, e.g., a surface with increased roughness as compared to other surfaces of the shoe upper). Additionally, the usage of suede (and/or any other leather) may provide the respective areas with water-repellent properties.

The first upper element may additionally be reinforced with a mesh element provided in the shape of the first upper element.

The mesh element may be used to solely reinforce the first upper element or may be provided in addition to a leather element (e.g., suede).

In a preferred case, the mesh element may be congruent to the first upper element. As an alternative, it may also be possible that the mesh element only covers a portion of the first upper element.

The mesh element may be a single mesh element or may be a combination of at least two mesh elements. Preferable, non-exclusive, mesh elements may, e.g., be nylon mesh, air mesh, lycra mesh, etc.

By providing the first upper element with a mesh, the breathability of the respective areas (at which the mesh is located) may be increased and the propensity of sweating of the foot of the athlete may be reduced. Moreover, the usage of mesh for reinforcing the first upper element may also allow a lightweight reinforcing. This may contribute to the wearing comfort of the shoe upper.

Another aspect of the invention relates to a shoe. The shoe may comprise the shoe upper as described elsewhere herein. Moreover, a bottom face of the second upper element may be adapted to be used as an outer sole of the shoe.

The second upper may be adapted such that it may provide a roughness such that the bottom face (the side of the second upper element which may be in contact with a street), may be used as an outer sole of the shoe. The roughness of the bottom face may be adapted such that desired pushing off capabilities of the shoe (e.g., during running), when worn by an athlete, may be provided. In such a case, no additional outer sole may be required.

The bottom face of the second upper may integrally be adapted to provide the desired roughness and/or the second upper element may at least partially be provided with an additional layer element which may be joined together with the second upper element on the bottom face of the second upper element such that the desired roughness is obtained.

The assembly of such a shoe may provide an easier manufacturing as less parts need to be assembled (e.g., no handling of an outer shoe sole is required) which may reduce the manufacturing time. Both aspects may contribute to decreased manufacturing costs. Since less parts are used for the assembly of the shoe, enhanced recyclability may be provided (as less parts need to be separated from each other and potentially treated differently) and the overall weight of the shoe may be reduced.

Another aspect of the invention relates to a shoe comprising the shoe upper as described elsewhere herein.

In some cases, the shoe upper may be joined together with an outer shoe sole. In such a case, preferably a bottom face of the second upper element may be joined together with an outer sole, e.g., by gluing, stitching, welding, etc. or a combination thereof.

The usage of an outer sole, in combination with a shoe upper as described elsewhere herein, may provide increased cushioning capabilities. Therefore, the joints and muscles of an athlete may be protected and injuries and/or pain may be prevented. Moreover, also fatigue of the leg muscles of an athlete may be reduced.

Another aspect of the invention relates to a method for manufacturing a shoe upper. The method may comprise providing first and second upper elements, wherein the second upper element may comprise at least a first set of wings protruding from the lateral and medial sides of the second upper element. Each wing may comprise a first merging area configured to attach the first upper element to the second upper element. Moreover, the wings of the at least first set of wings may be transformed from a planar orientation into a three-dimensional orientation towards the first upper element. Moreover, the first upper element and the second upper element may be joined together along the transformed wings, in the first merging area, such that the first upper element and the second upper element may be joined together upwards from a ball area of the shoe upper to a heel area of the shoe upper.

In an initial state of the method, the first upper element and the second upper element may be understood as planar elements (with a predominantly two-dimensional extension, when neglecting their thickness). Prior to joining the first upper element together with the second upper element, at least the wings of the first set of wings may be folded upwards (e.g., towards the sky) such that at least the second upper element may acquire a three-dimensional shape and to allow a joining together of the second upper element with the first upper element.

BRIEF DESCRIPTION OF THE FIGURES

Aspects of the present invention will be explained in more detail with reference to the accompanying figures in the following. These figures show.

DETAILED DESCRIPTION

In the following, embodiments and variations of the present invention are described in more detail by means of a shoe upper, in particular, a shoe upper for a sports shoe. It is, however, emphasized that the present invention is not limited to this and that also combinations of the embodiments may be possible.

Figure 1:
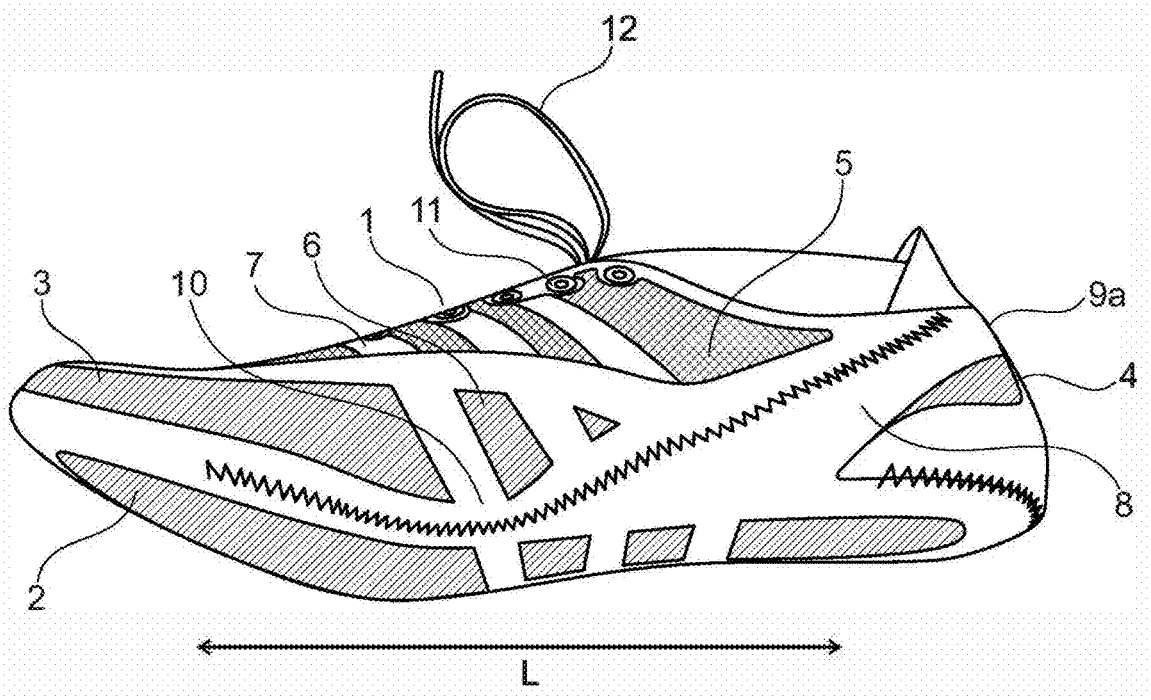
FIG. 1: Illustrative overview of an exemplary shoe upper.

FIG. 1 shows a schematic drawing of a shoe upper to support the understanding of the nomenclature of the different areas of a shoe upper as used throughout this application.

An exemplary shoe upper 1 comprises a bottom face 2, which, in some embodiments, can act as an (outer) sole of the shoe upper 1. The bottom face 2 may refer to a face which is averted from the wearer of the shoe and may thus point towards a street along which the wearer of the shoe may move.

The shoe upper 1 further comprises a toe area 3 in which the toes of the foot of the wearer may be located when the shoe upper 1 is worn. The toe area 3 may also be understood as a front side of the shoe upper.

On a respective opposing side of the shoe upper 1, i.e., on a back side of the shoe upper 1, a heel area 4 is located. In the heel area 4, the Achilles' heel of the foot of the wearer may be accommodated when the shoe upper 1 is worn.

The toe area 3 and the heel area 4 are opposing with respect to a transverse axis T, which may be substantially perpendicular to a longitudinal axis L, wherein the transverse axis T (not visible in FIG. 1) is located at half the longitudinal extension of the longitudinal axis L. The longitudinal axis L may be associated with the length direction of the shoe upper 1, along which, the shoe upper 1 may extend whereas the transverse axis may be understood as referring to the width (e.g., a horizontal shortest distance from a distal surface of the shoe upper 1 to a proximal surface of the shoe upper 1) of the shoe upper 1 which may be measured transversal (neglecting manufacturing uncertainties) to the longitudinal axis L.

The shoe upper 1 further comprises a quarter portion 5 which is located at a region in which an ankle (e.g., the malleolar bone) of the foot of the wearer may be located when the shoe upper 1 is worn. Quarter portion 5 is located on a left lateral side of the shoe upper 1 and is located on a right lateral side of the shoe upper 1.

The shoe upper 1 further comprises a vamp portion 6, wherein the vamp portion 6 is adapted to accommodate a midfoot area of the foot of the wearer when shoe upper 1 is worn. Vamp portion 6 is located on a left lateral side of the shoe upper 1 and on a right lateral side of the shoe upper 1.

The shoe upper 1 further comprises a first upper element 7 and a second upper element 8. The first upper element 7 may be adapted such that it at least partially forms the vamp portion 6 and such that it at least partially forms the quarter portion 5 of the shoe upper 1.

The first upper element 7 and the second upper element 8 are joined together in a first merging area 9*a* (and in a first merging area 9*b* disposed on a respective opposing lateral side of the shoe upper 1) extending diagonally upwards from a ball area 10 of the shoe upper 1 to an upper heel area 4 of the shoe upper 1.

The first upper element 7 may comprise (at least one) eyelets 11, adapted to receive a shoelace 12.

Figure 2A:
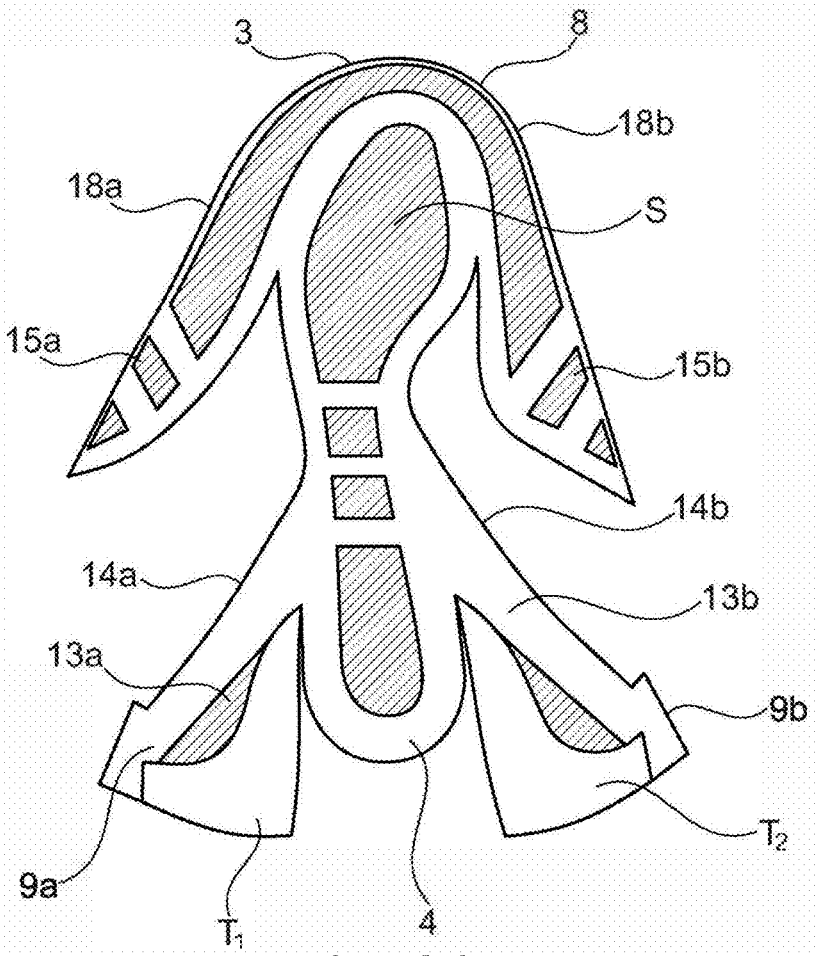
FIGS. 2A-2B: Illustration of a first upper element and a second upper element according to an embodiment.

FIG. 2A depicts an exemplary embodiment of the second upper element 8. Second upper element 8, as seen from a top-view and in a non-assembled state of the shoe upper 1 is preferably provided in the shape of a foot sole S of the foot of the wearer. In this context, FIG. 2A shows the second upper element 8 as it is worn on a left foot of the wearer.

Second upper element 8 comprises a first set of (e.g., two) wings 13*a* and 13*b* protruding from lateral and medial sides of the second upper element 8. The first set of two wings 13*a* and 13*b* protrudes in the heel area 4 of the shoe upper 1.

Each of the wings of the first set of two wings 13*a* and 13*b* is provided with a respective first merging area 9*a* and a respective first merging area 9*b* along which the second upper element 8 is joined together first upper element 7 (not depicted in FIG. 2A). In some embodiments, the first merging areas 9*a* and 9*b* may essentially relate to the edge of the wings (e.g., at an outermost location of the wings) of the first set of two wings 13*a* and 13*b*. Additionally or alternatively, the first merging areas 9*a* and 9*b* may also extend across at least a portion of each of the wings of the first set of two wings 13*a* and 13*b*.

Each of the wings of the first set of two wings 13*a* and 13*b* may, in some cases, be provided with a respective second merging area 14*a* and a respective second merging area 14*b* which predominantly extend along a respective edge on a right side of the shoe upper and on a respective edge on a left side of the shoe upper.

In the exemplary embodiment, each of the wings of the first set of wings 13*a* and 13*b* is further equipped with a reinforcement element in form of a thermoplastic polyurethane, TPU, element T1 and T2. The TPU elements T1 and T2 are adapted to reinforce the respective first merging areas 9*a* and 9*b* of the first set of two wings 13*a* and 13*b*. Additionally or alternatively, the TPU elements T1 and T2 may also be used to provide the shoe upper with a design element. To emphasize the effect of an optical distinction, TPU elements T1 and/or T2 may be provided with a color that differs from the color of the first upper element and/or the second upper element such that the shoe upper may be provided with an accent of color.

The second upper element 8 further comprises a second set of two wings 15*a* and 15*b*, preferably in the toe area 3 of the shoe upper. The second set of two wings 15*a* and 15*b* are arranged on opposing lateral sides of the second upper element 8.

Each of the two wings of the second set of two wings 15*a* and 15*b* comprises a respective third merging area 18*a* and a respective third merging 18*b*. The third merging areas 18*a* and 18*b* may be implemented identical to the first merging areas 9*a* and 9*b* and the second merging areas 14*a* and 14*b* as described above.

Figure 2B:
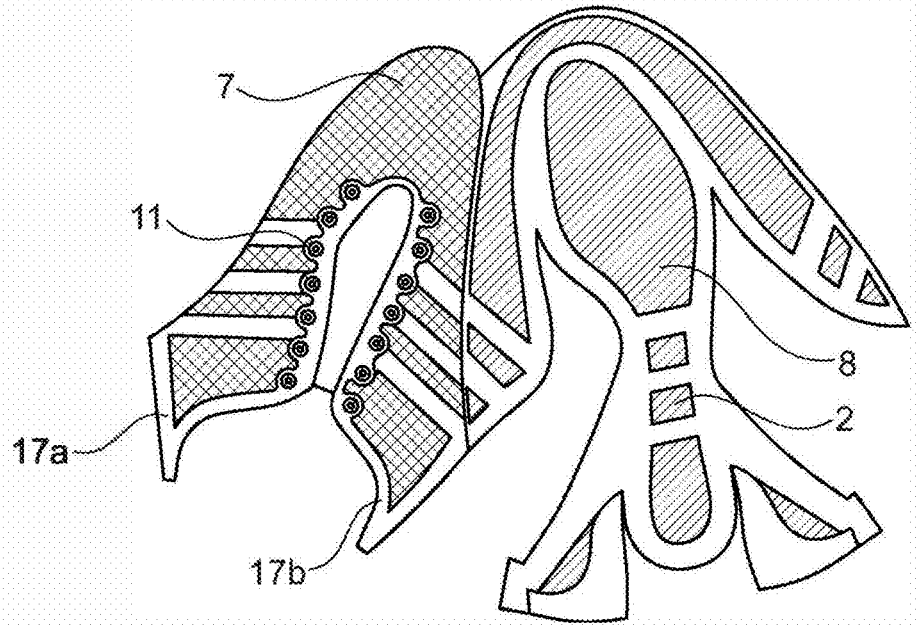

FIG. 2B shows a side-to-side view of the second upper element 8 (bottom face 2) and the first upper element 7. The second upper element 8 is implemented identical to the second upper element 8 as described beforehand with reference to FIG. 2A.

The first upper element 7 is in this example adapted to form the vamp portion 6 and the quarter portion 5 of the shoe upper 1 and is thus also adapted to form the upper portion of shoe upper 1. The first upper element 7 comprises first merging portions 17*a* and 17*b*, located on opposing sides of the shoe upper 1, which are be adapted to be joined together with the respective first merging areas 9*a* and 9*b* of the second upper element 8. More specifically, merging portion 17*a* may be adapted to be joined together with the first merging area 9*a* of the second upper element 8 whereas merging portion 17*b* may be adapted to be joined together with the first merging area 9*b* of the second upper element 8.

The first upper element 7 may further comprise second merging portions 19*a* and 19*b* on opposing sides of the shoe upper 1. Second merging portions 19*a* and 19*b* may be adapted to be joined together with the third merging areas 18*a* and 18*b* of the second upper element 8. More specifically, second merging portion 19*a* is adapted to be joined together with the third merging area 18*a* and the second merging portion 19*b* is adapted to be joined together with the third merging area 18*b*.

The first upper element 7 further comprises one or more eyelets 11, wherein the one or more eyelets 11 are adapted to receive a shoelace (not depicted in FIG. 2B) to further tighten the shoe upper 1 when worn by the wearer. The eyelet 11 may be formed by an embroidery process, eyelet hole punching and/or tongue stitching or other such conventional means in the art.

FIGS. 3A-3D show steps of an exemplary assembly process of the shoe upper 1 according to aspects as described herein.

Figure 3A:
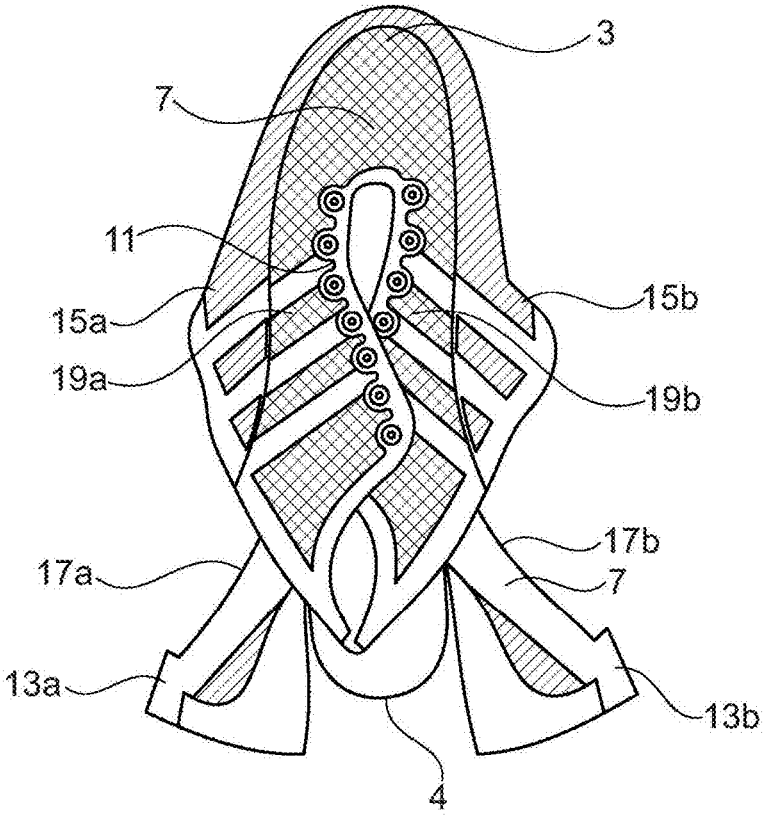
FIGS. 3A-3D: Illustration of an exemplary assembly process of a shoe upper according to an embodiment.

FIG. 3A shows a top-view onto a superposition of the first upper element 7 placed on the second upper element 8, wherein the second upper element 8 has been rotated by 180° along its longitudinal axis (upside down) as compared the orientation of the second upper element 8 depicted in FIG. 2B. Moreover, FIG. 3A intends to depict an exemplary size ratio of the first upper element 7 and the second upper element 8 in direct comparison.

In the arrangement of the first upper element 7 and the second upper element 8, as shown in FIG. 3A, it can be seen that the second set of two wings 15*a* and 15*b* may be directly located adjacent to the second merging portions 18*a* and 18*b* of the first upper element 7 for joining together the respective wings of the second set of two wings 15*a* and 15*b* and the second merging portions 18*a* and 18*b*.

Moreover, in the depicted top-view, the wings of the first set of two wings 13*a* and 13*b* may be located adjacent to the first merging portions 17*a* and 17*b* in the heel area 4.

Figure 3B:
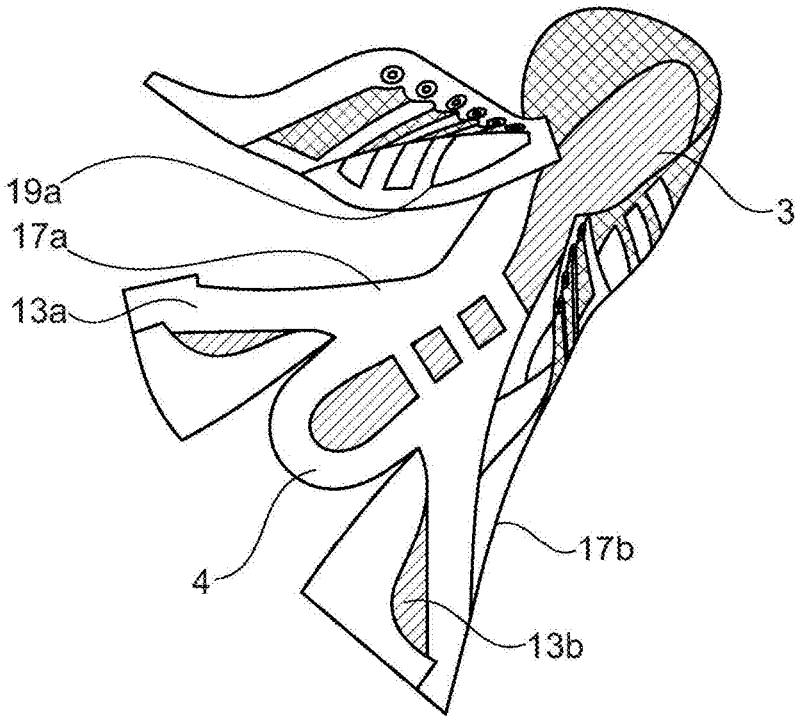

FIG. 3B shows an exemplary assembly step (which may occur subsequent to the assembly step as described with reference to FIG. 3A, above) of the assembly process of the shoe upper 1 in which the shoe upper 1 has be transformed into a 3-dimensional-like shape.

In the assembly stage, as depicted in FIG. 3B, the right wing 15*b* of the second set of two wings 15*a* and 15*b* of the second upper element 8 is joined together with a respective right merging portion 19*b* of the first upper element 7.

For illustration purposes, the (left) wing 15*a* of the second set of two wings 15*a* and 15*b* is not joined together with its respective merging portion 19*a* of the first upper element 7.

In FIG. 3B, the wings of the second set of two wings 13*a* and 13*b* of the second upper element 8 are not joined together with the respective first merging portions 17*a* and 17*b* (of the first upper element 7) in the heel area 4. It is noted that in FIG. 3B, the second upper element 8 has been turned upside down (as compared to the illustration in FIG. 2B (right hand-side) in preparation to the assembly of the shoe upper.

Figure 3C:
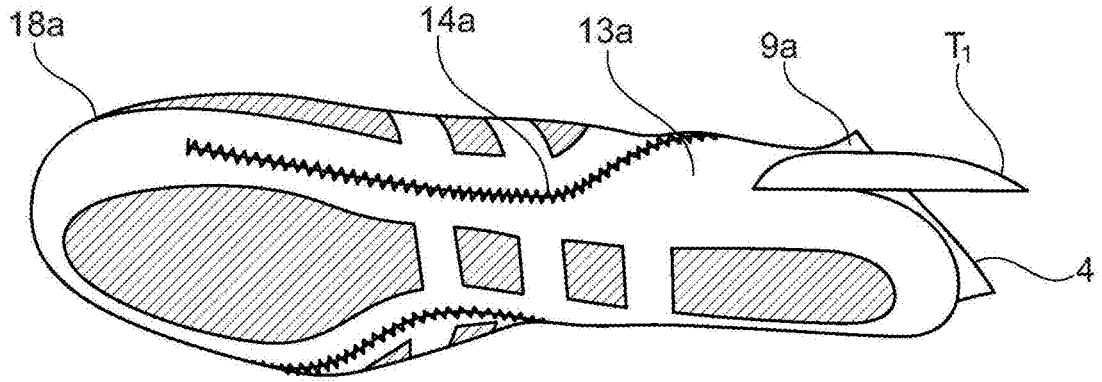

FIG. 3C shows an exemplary (subsequent) assembly step of the assembly process of the shoe or the shoe upper 1. Notably, FIG. 3C shows a view onto the bottom face 2 of the shoe upper 1.

In the depicted stage of the assembly process, the first upper element 7 and the second upper element 8 are joined together at least in the toe area 3. Moreover, in FIG. 3C, the first upper element 7 is also joined together with the second upper element 8 along the first merging areas 9*a* and 9*b* (not shown in FIG. 3C), at least in the quarter portion 5. In FIG. 3C, also the second merging areas 14*a* and 14*b* (not shown in FIG. 3C) are joined together with the first upper element 7 and the third merging areas 18*a* and 18*b* (not shown in FIG. 3C) are joined together with the first upper element 7. In FIG. 3C, the first merging areas 9*a*, 9*b*, the second merging areas 14*a* and 14*b* and the third merging areas 18*a* and 18*b* are implemented as stitching lines.

In the depicted stage of the assembly process, at least the TPU element T1 is (not yet) joined together with TPU element T2?.

Figure 3D:
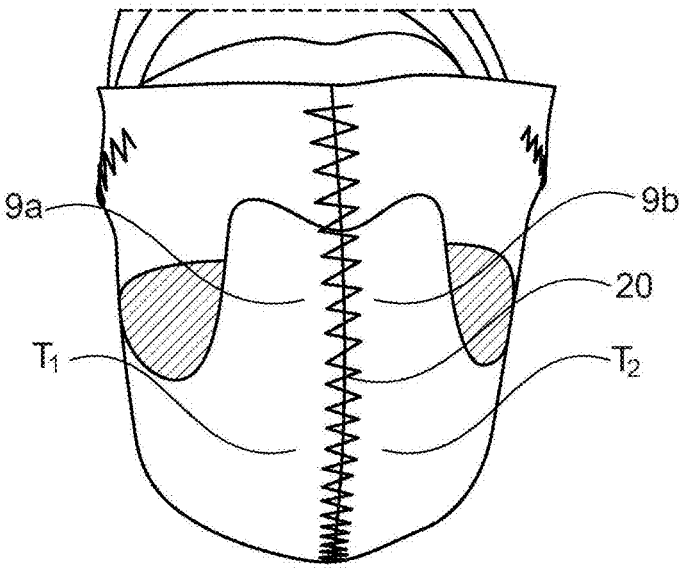

FIG. 3D shows an (final) exemplary step of the assembly process of the shoe upper 1, which may occur subsequent to the step of the assembly process as outlined with reference to FIG. 3C, above.

In particular, FIG. 3D depicts a view onto the heel area 4 of the shoe upper 1, wherein the first TPU element T1 and the second TPU element T2 are joined together in an exemplary in the first merging areas 9*a*, 9*b*, which may, inter alia, extending from a bottom portion of the heel area 4 to an upper portion of the heel area 4 of the shoe upper 1. The first merging areas 9*a* and 9*b* area joined together by means of stitch line 20.

Figure 4A:
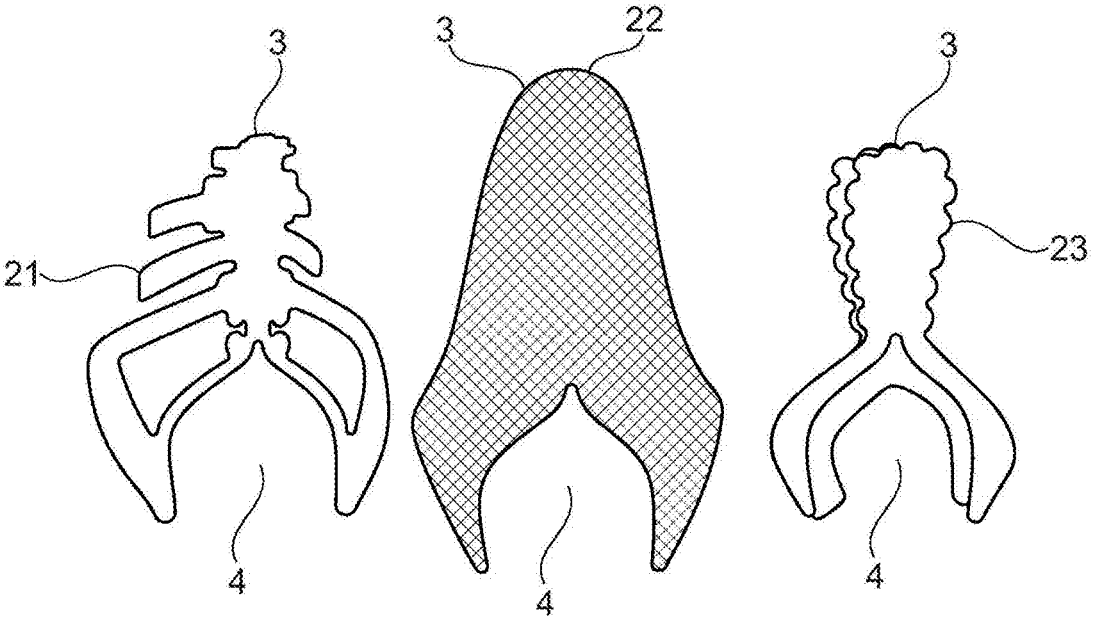
FIGS. 4A-4B: Overview of additional optional components for a first upper element of a shoe upper according to an embodiment.
Figure 4B:
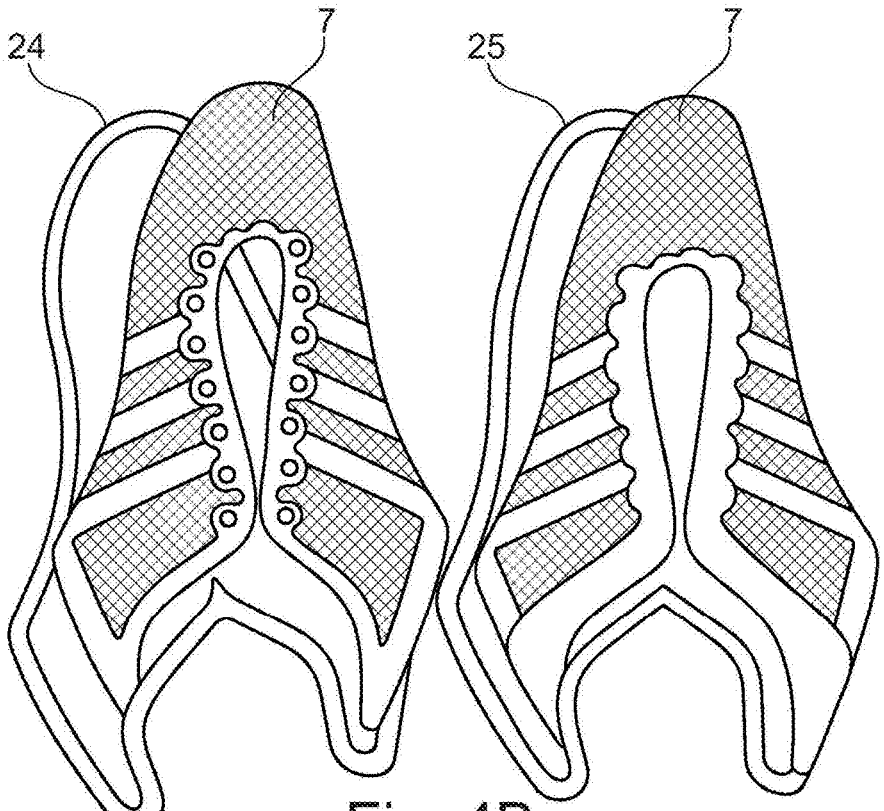

FIGS. 4A and 4B show exemplary embodiments of optional components the first upper element 7 of the shoe upper 1 may be provided with. Said components may be used to provide the shoe upper 1 with additional, desired functional properties as will further be described below. It is noted that the components described with reference to FIGS. 4A and 4B below may be implemented into the shoe upper 1 in a no-sew arrangement (in which no sewing/stitching is required and wherein the respective components are joined together, e.g., by heat pressing) and/or by sewing/stitching. It is further noted that any of the optional components as described below may exclusively be included into the shoe upper 1 or may be combined with each other. Each of the components as described below may be congruent to the first upper element 7 or may only cover certain portions of the first upper element 7.

Notably, FIG. 4A shows optional components for the first upper element 7 which may provide the first upper element 7 with additional stiffness, strength resistance, breathability or with an optical distinction (e.g., arising from a different color of the respective component and/or a different material (composition) of the respective component).

More specifically, the first upper element 7 may be provided with a TPU element 21 which may be in the shape of a skeleton of the first upper element 7.

Additionally, or alternatively, it may also be possible that the first upper element 7 is provided with a mesh element 22. The mesh element 22 may advantageously provide the first upper element 7 with increased breathability and wearing comfort (as the mesh element 22 may act as a cushioning element against, e.g., eyelet 11 (not shown in FIG. 4A) and/or a shoelace which may be prevented from being in direct contact with a foot of the wearer of the shoe upper 1).

Additionally, or alternatively, it may also be possible that the first upper element 7 is provided with a synthetic suede and/or a hot melt, for example, cooper II flex layer 23 (to support bonding). In particular, the usage of synthetic suede may provide the respective portions of the first upper element 7 (at which the suede is located) with additionally stability, e.g., with respect to tear strength, abrasion resistance, etc. In some cases, synthetic suede may also be used for increased thermal insulation such that a hypothermic state of the foot of the wearer may be avoided. In some cases, synthetic suede may also be used as an optical distinction element of the first upper element 7, e.g., due to its color and/or material appearance.

FIG. 4B shows further optional components to be implemented in the first upper element 7, which may preferably provide the first upper element 7 with increased stability and/or optical distinction. Any of the components shown in FIG. 4B may exclusively be implemented in the first upper element 7 or combined with one or more of the optional components described with reference to FIG. 4A, above.

In some cases, the first upper element 7 may be provided with a contour element 24 which may preferably be provided in the shape of the contour (outer circumferential shape) of the first upper element 7. The contour element 24 may be an integrally formed piece or may be composed of one or more separate parts. The contour element 24 may be provided in a single color.

In some cases, the first upper element 7 may alternatively or additionally be provided with a contour element 25 which is provided in more than one color which may match the respective colors of the first upper element 7 in regions in which the contour element 25 may joined together with the first upper element 7.

Contour elements 24 and 25 may be made from TPU, a plastic material and/or any other suitable material.

Figure 5A:
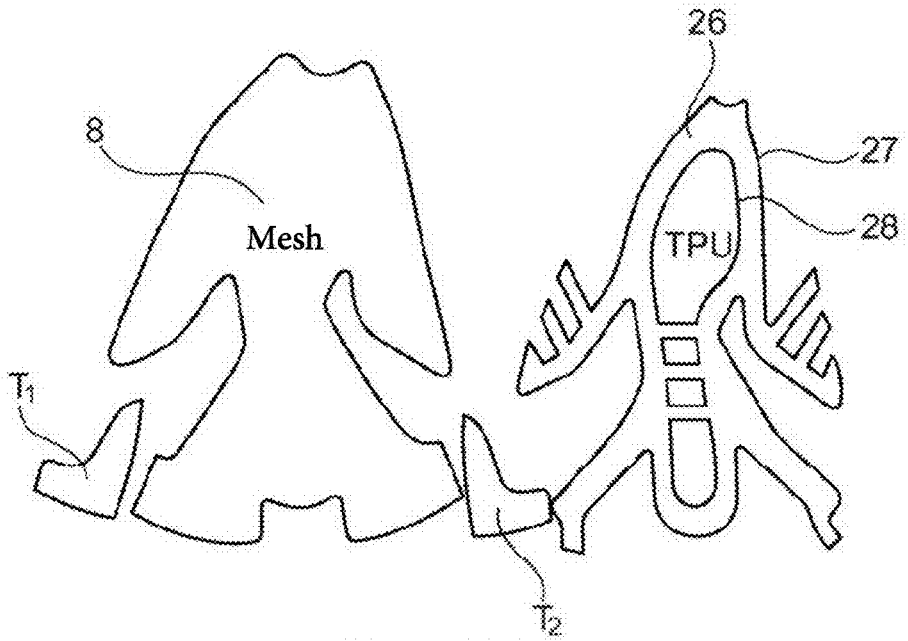
FIGS. 5A-5C: Overview of additional optional components for a second upper element of a shoe upper according to an embodiment.
Figure 5B:
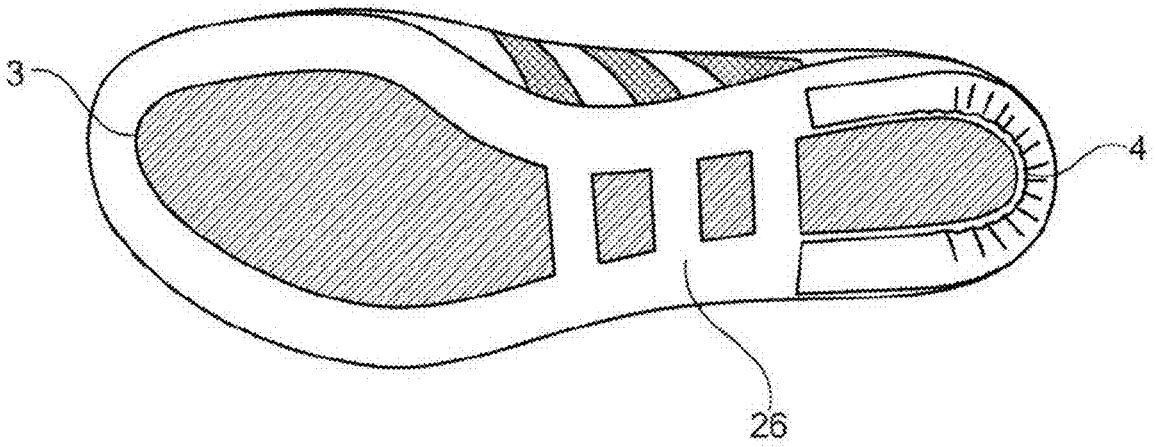
Figure 5C:
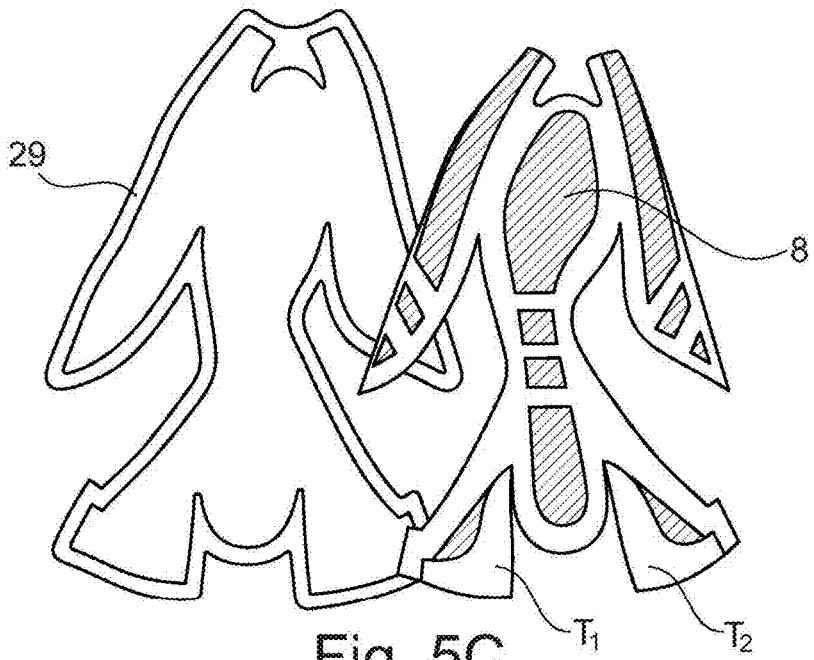

FIGS. 5A-5C show an exemplary embodiment of the second upper element 8, wherein the second upper element 8 is provided with means for increasing the stability and/or to provide the second upper element 8 with an optical distinction. It is emphasized that the embodiments outlined herein may be exclusively used for the assembly of the shoe upper 1 or may be combined with one or more of the embodiments as described elsewhere herein.

FIG. 5A shows the second upper element 8, implemented as described herein, and which may be made from a mesh material. The second upper element 8 may optionally be provided with TPU elements T1 and T2.

The second upper element 8 may additionally be provided with TPU element 26 (right hand-side of FIG. 5A). TPU element 26 may preferably be joined together with the second upper element 8 at the bottom face 2 (not shown in FIG. 5A) of the second upper element 8. In some scenarios, the TPU element 26 may also be joined together with the second upper element 8 at a respective upper face (e.g., facing towards the foot of the wearer of the second upper element 8 is worn as the shoe upper 1) of the second upper element 8.

The TPU element 26 is provided in a shape to match the contour of the second upper element 8. The TPU element 26 preferably extends from the edge 27 of the second upper element 8 towards the center 28 of the second upper element 8, preferably for not more than 15 mm.

FIG. 5B shows the bottom side of the shoe upper 1, according to an embodiment described herein, wherein the second upper element 8 has been provided with the TPU element 26 on the bottom face 2. The TPU element 26 may be joined together with the second upper element 8 by a primer and/or a glue. The TPU element may prevent any adhesives from entering the inside-bottom of the shoe upper 1 and to increase the bonding strength and/or stability of the shoe upper 1.

FIG. 5C shows an exemplary embodiment of the second upper element 8 in which the TPU elements T1 and T2 have been attached to the second upper element 8.

Similar to the first upper element 7, also the second upper element 8 may be provided with a respective contour element 29 which may be provided in the shape of an outer contour of the second upper element 8. Besides from the shape of the contour element 29, the contour element 29 may be implemented identical to the contour elements 24 or 25 as described with reference to FIG. 4B, above.

Figure 6A:
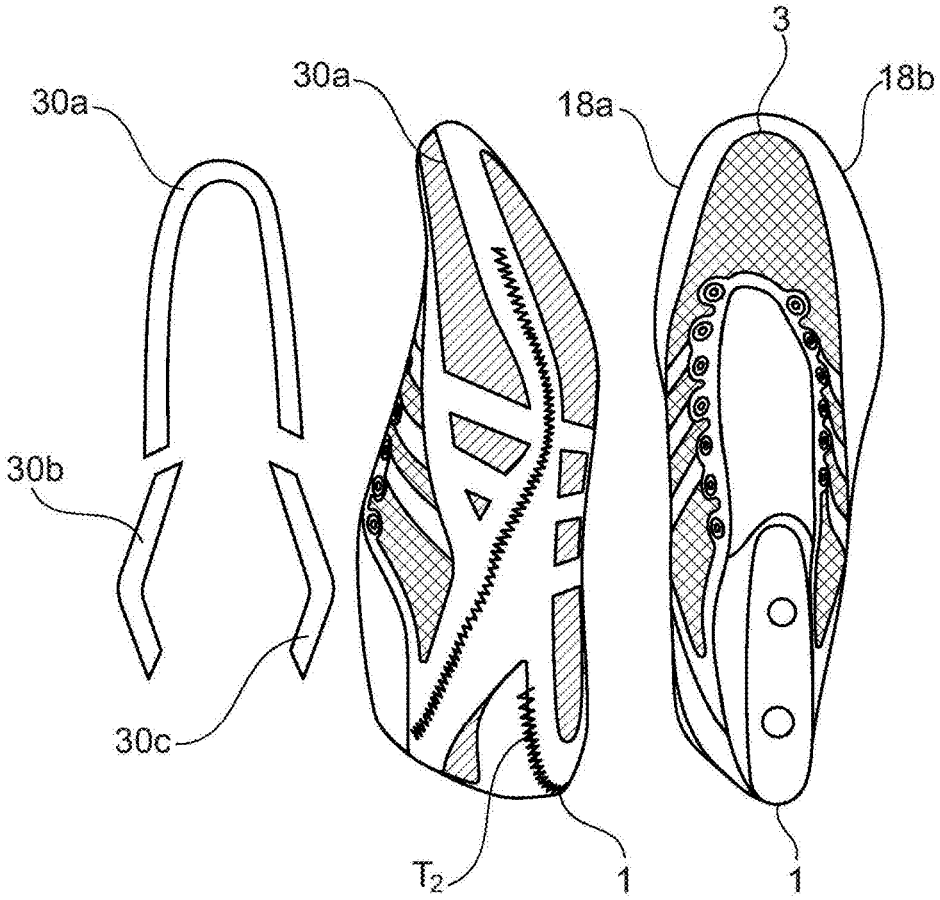
FIGS. 6A-6B: Overview of additional optional components for a shoe upper according to an embodiment.
Figure 6B:
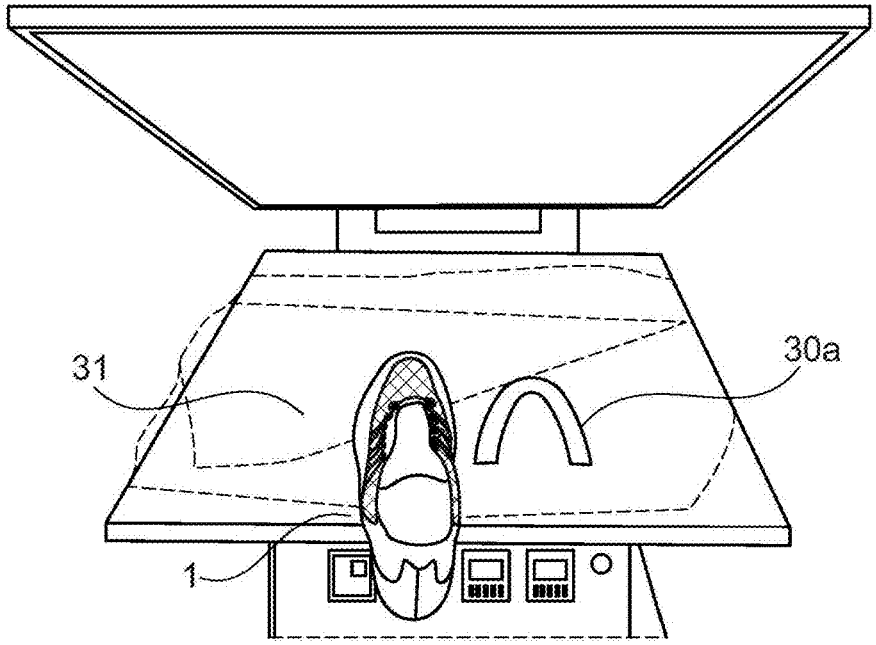

FIGS. 6A and 6B show an exemplary embodiment how the first upper element 7 and the second upper element 8 may be joined together comprising the step of heat pressing/rubber molding.

FIG. 6A shows three rubber elements 30*a*-30*c* which are adapted to be arranged on the respective locations of at least the first merging areas 13*a* and 13*b* and/or the third merging areas 18*a* and 18*b* such that the first upper element 7 and the second upper element 8 may be joined together on an upper side of the shoe upper 1 and in the toe area 3 such that the toes of the wearer of the shoe upper preferably do not come into contact with the respective third merging areas 18*a* and 18*b* which supports an aspect of the invention that the inventive shoe upper 1 does not require a Strobel arrangement.

It may be possible that rubber element 30*a* is exclusively used for joining together the first upper element 7 and the second upper element 8 or that the rubber element 30*a* is used in addition to a sewing/stitching procedure for joining together the first upper element 7 and the second upper element 8 such as to, e.g., reinforce the stitching, to provide the shoe upper 1 with an optical distinction and/or to protect the stitching against potential abrasion.

FIG. 6B shows an exemplary manufacturing step of how the rubber elements 30*a*-30*c* may be attached to the shoe upper 1.

In the exemplary case, shoe upper 1 is placed in a heat press 31. At least the rubber element 30*a* (shown adjacent to the shoe upper 1 in FIG. 6B) may, in a subsequent step, then be placed at the desired location of shoe upper 1 at which it is supposed to be attached to the shoe upper 1 (notably, rubber element 30*a* may be placed at the third merging areas 18*a* and 18*b*). By closing the heat press 31, and at least heating the upper heat press element, rubber element 30*a* (as an example) may be heated and at least partially be molten (such that rubber element 30*a* may become deformable and may stick to the desired location on the shoe upper 1).

FIGS. 7A-7F show an exemplary embodiment the shoe upper 1 provided with the aforementioned rubber elements 30*a*-30*c* in various perspectives.

Figure 7A:
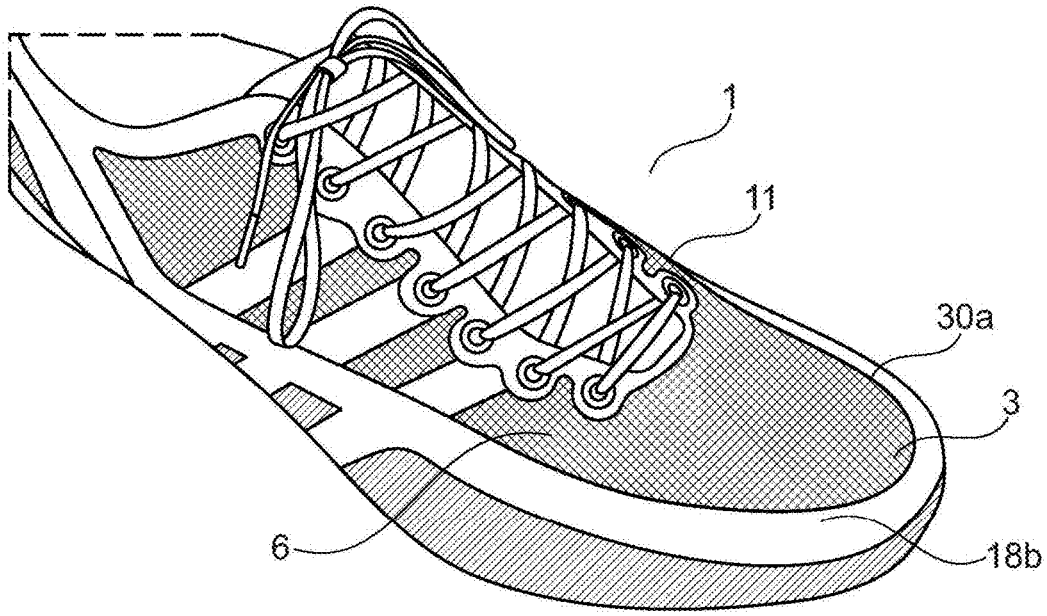
FIGS. 7A-7F: Illustration of a shoe upper (and shoe) according to an embodiment.

FIG. 7A shows the toe area 3 and the vamp portion 6 of shoe upper 1 as seen from an elevated lateral view. FIG. 7A shows rubber element 30*a* wound, and preferably heat pressed, about the toe-most portion of the toe area 3 in which the third merging areas 18*a* and 18*b* are located.

Figure 7B:
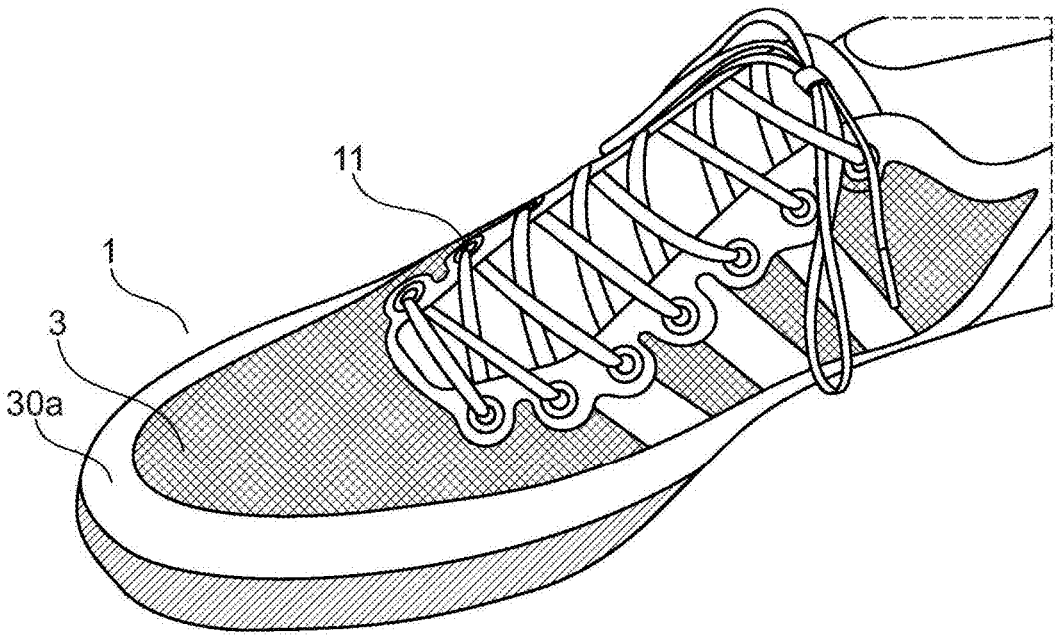

FIG. 7B shoes the shoe upper 1 as depicted in FIG. 7A from an elevated medial view.

Figure 7C:
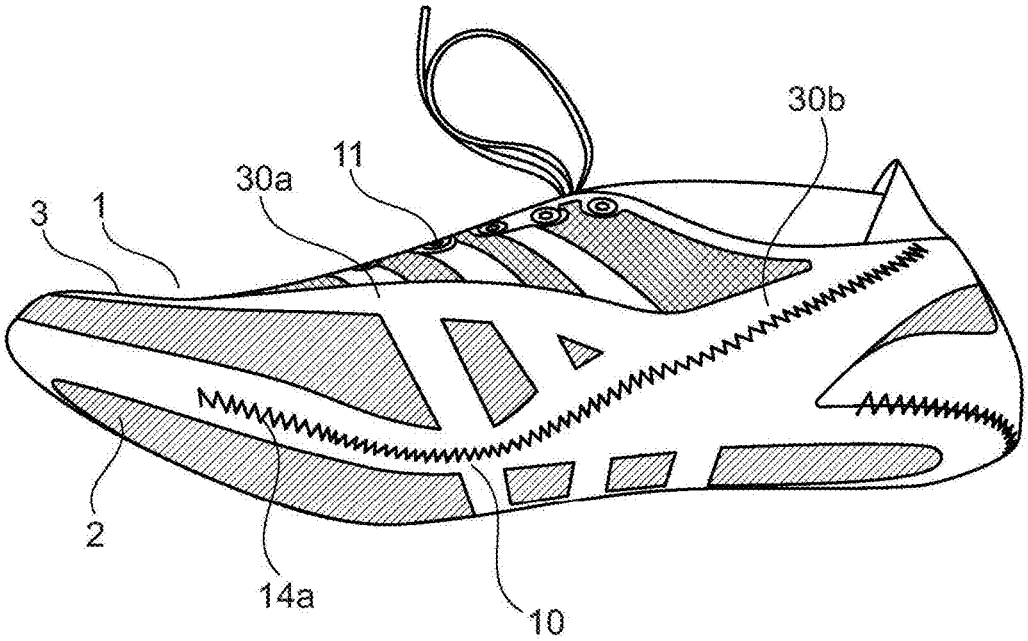

FIG. 7C shoes the shoe upper 1 as depicted in FIGS. 7A and 7B and shows the toe area 3 and (partially) vamp portion 6 in a lateral side view.

In particular, FIG. 7C shows a portion of rubber element 30*a* and of rubber element 30*b*. Rubber element 30*b* is arranged adjacent to the first merging area 9*a*, which in FIG. 7C, is exemplarily depicted as a line, preferably a stitching line. It is stressed that first merging area 9*a* extends diagonally upwards from a ball area 10 of the shoe upper 1 to an upper heel area (not shown in FIG. 7C) of the shoe upper 1. In a preferred embodiment, at least the first merging 9*a* further extends along a respective edge on a left/medial side of the shoe upper 1 (in the second merging area 14*b*) towards the toe area 3 of the shoe upper 1.

Figure 7D:
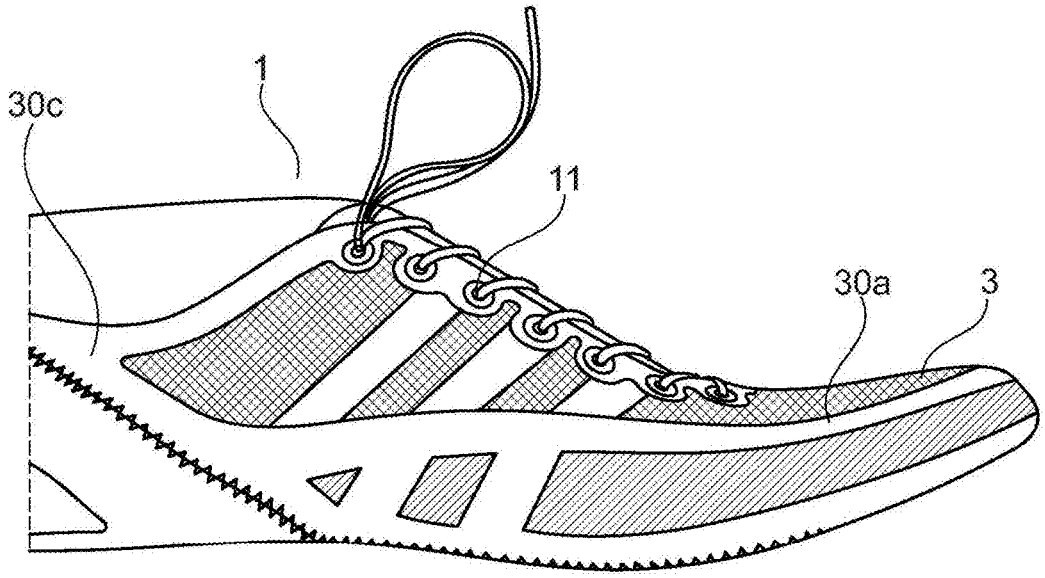

FIG. 7D shows the shoe upper 1 as depicted in FIGS. 7A-7C and shows the toe area 3 and (partially) vamp portion 6 as seen from a medial side view.

FIG. 7D further shows first merging area 9*b* which is located on an opposing side of the first merging area 9*a* of the shoe upper 1, relative to a longitudinal line of the shoe upper 1. First merging area 9*b* may be implemented identically to the first merging area 9*a*. The rubber element 30*c* may be located adjacent to the first merging area 9*b* and may be implemented identical to the rubber element 30*b*.

Figure 7E:
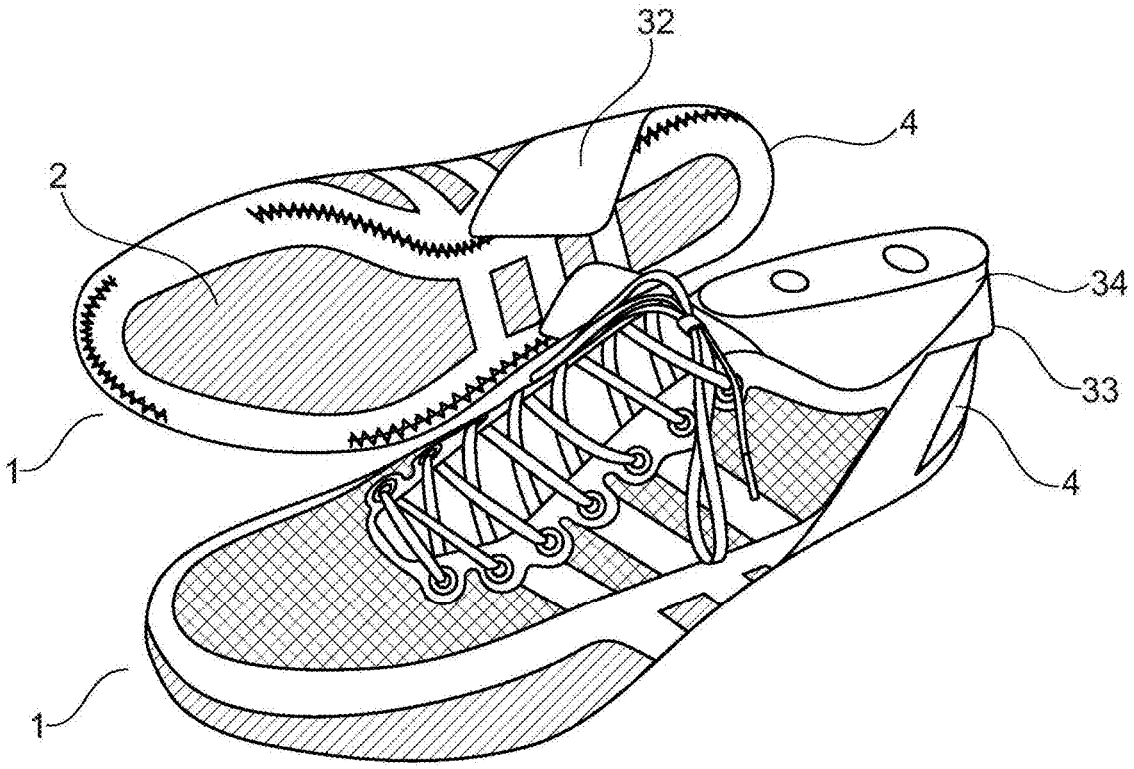

FIG. 7E (lower right-hand side of FIG. 7E) shows the shoe upper 1 in an elevated skewed view as seen from a lateral side. In some cases, the shoe upper 1 may additionally or alternatively to the aspects described above be provided with a longitudinal reinforcing element 32 which may be wrapped around the heel area 4 and attached to two opposing sides of the shoe upper 1. The reinforcing element 32 may be adapted similar to rubber-like elements known from climbing shoes (in a respective heel area 4). The longitudinal reinforcing element 32 may be attached to the shoe upper 1 by at least one of gluing, heat pressing, sewing, etc.

The shoe upper 1, depicted in the lower right-hand side of FIG. 7E, may further be provided with a heel blinker 33, wherein the upper most portion of the heel blinker 33, which is protruding from a throat opening 34 of the shoe upper 1, is folded to the outer surface of the shoe upper 1.

The shoe upper 1 shown in the upper left hand-side of FIG. 7E further depicts the bottom face 2 of the shoe upper 1 in a skewed elevated view and shows the longitudinal reinforcing element 32 which may also extend to a portion of the bottom face 2 of the shoe upper 1, up to the ball area 10, of the shoe upper 1.

Figure 7F:
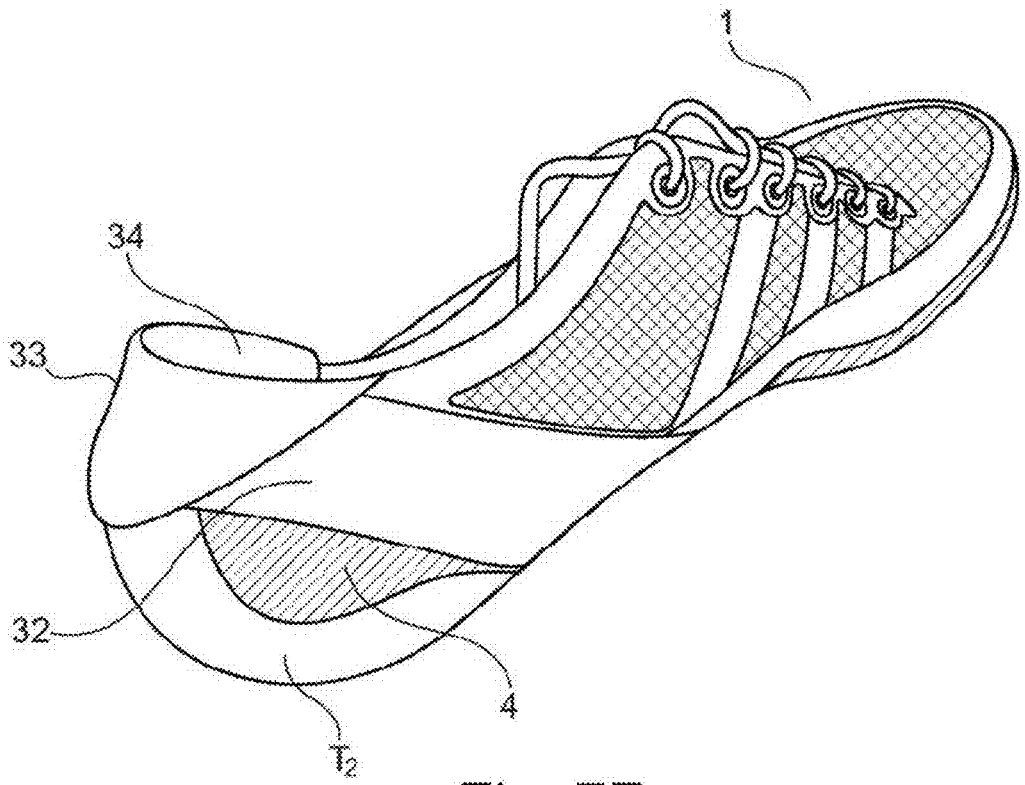

FIG. 7F shows the shoe upper 1 as seen from an elevated perspective view onto the heel area 4 of the shoe upper 1. In this view, it can be seen that the heel blinker 33 is at least partially wrapped over the longitudinal reinforcing element 32. In this view also TPU element T2 is visible.

FIGS. 8A-8D show the implementation of the heel blinker 33 with which the shoe upper 1 may optionally be provided with. Providing the shoe upper 1 with the heel blinker 33 may be combined with other components the shoe upper 1 may be provided with as described herein. A heel blinker 33 may be used to provide the shoe upper 1 with additional stability in the heel area 4 of the shoe upper 1 and/or for optical distinction.

Figure 8A:
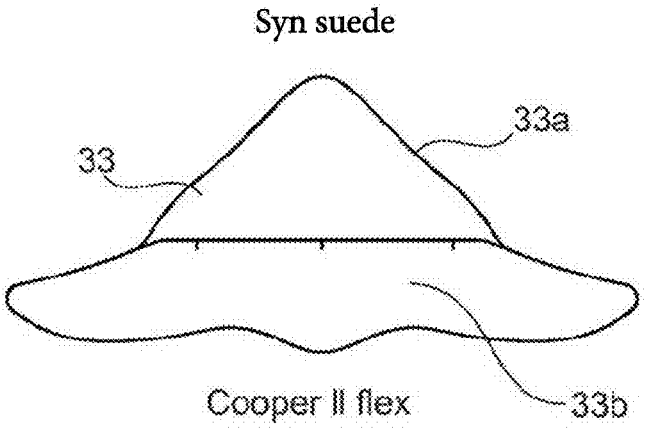
FIGS. 8A-8D: Illustration of an exemplary shoe upper assembly according to an embodiment comprising a heel blinker.
Figure 9A:
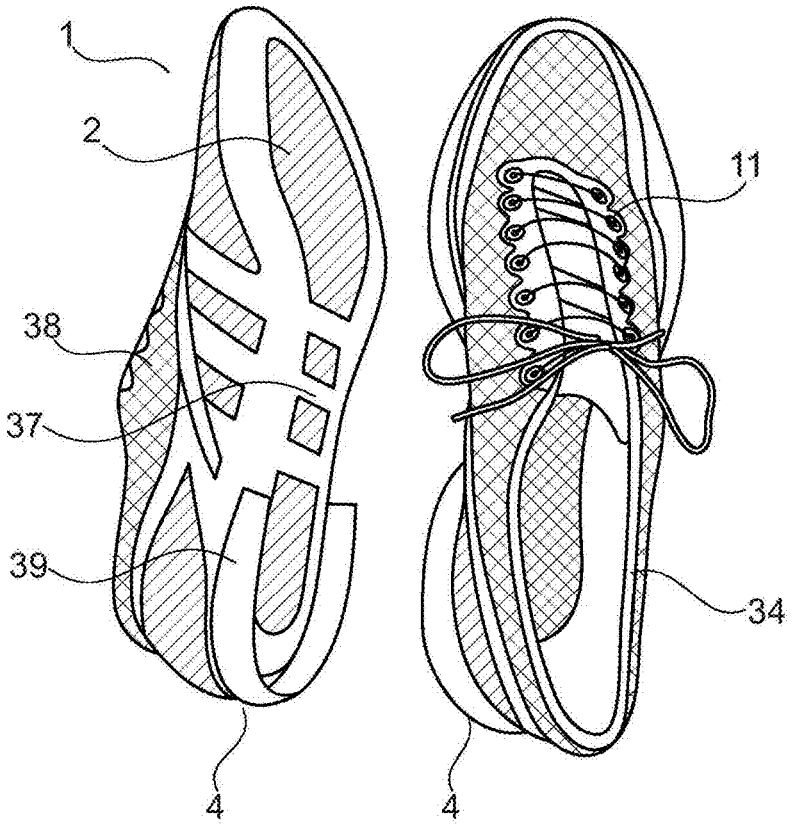
FIGS. 9A-9D: Illustration of an exemplary shoe upper according to an embodiment.

FIG. 8A shows an exemplary embodiment of the heel blinker 33, which, in a preferable embodiment, may be made from a synthetic suede element 33*a*. In a preferred embodiment, and as depicted in FIG. 9A, the heel blinker 33 may additionally be provided with a cooper II flex element 33*b*.

Figure 8B:
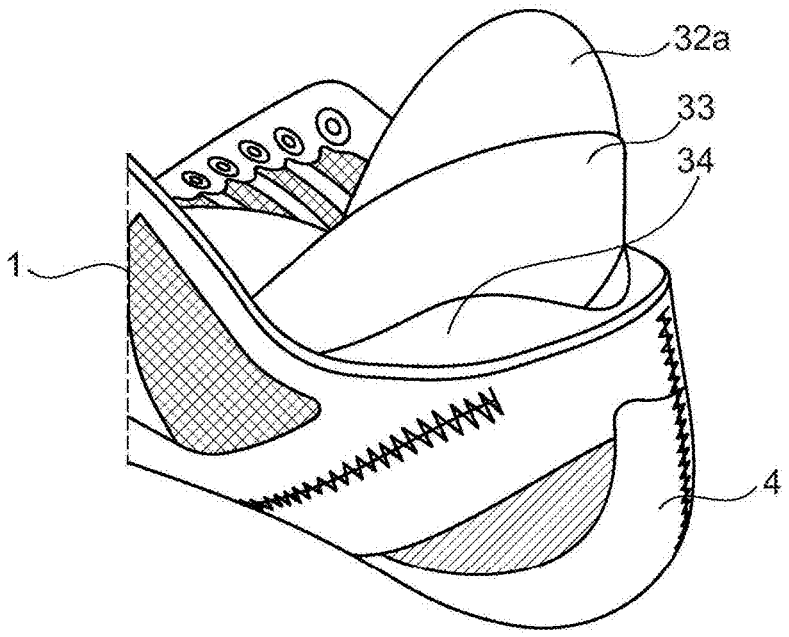

FIG. 8B shows an exemplary assembly step how the heel blinker 33 may be inserted into the shoe upper 1. In FIG. 8B, heel blinker 33 is formed into a curved shape and then inserted into the shoe upper 1 (through a throat opening 34). Heel blinker 33 may preferably inserted into the shoe upper 1 such that at least a portion of the synthetic suede element 32*a* is protruding out of the throat opening 34 the shoe upper 1 at the heel area 4.

Figure 8C:
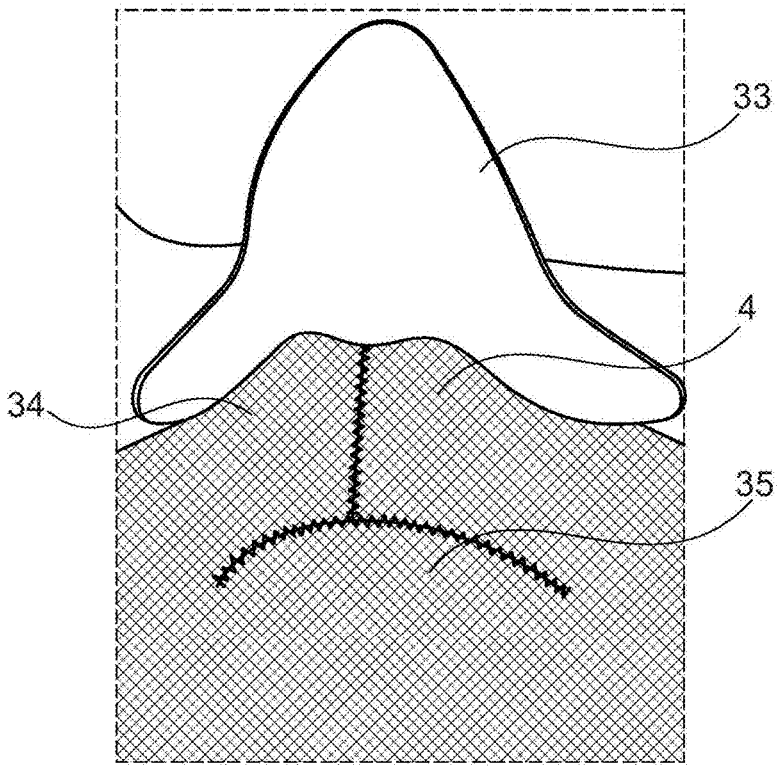

FIG. 8C shows a view into the shoe upper 1 and along the longitudinal axis of the shoe upper 1 onto the heel blinker 33, after the heel blinker 33 has been inserted into the shoe upper 1.

FIG. 8C further shows the inner surface 35 of the shoe upper 1 which, in FIG. 8C, is made from a mesh material and which corresponds to an upper face of the second upper element 8.

Figure 8D:
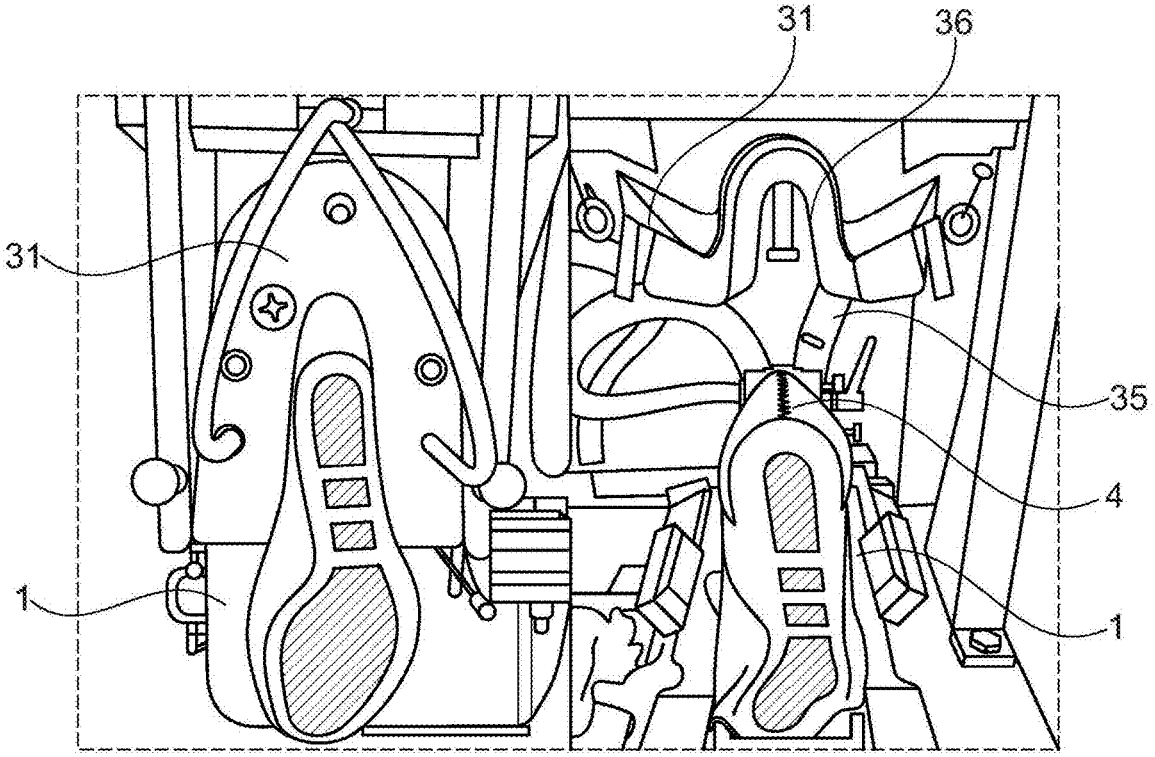

FIG. 8D shows an exemplary assembly step how the heel blinker 33 may be joined together with the shoe upper 1, preferably by heat pressing. FIG. 8D (left hand-side) shows an exemplary heat press 31 which may be adapted to receive the heal area 4 of the shoe upper 1 by means of a shoe upper holding structure 35.

Heel blinker 33 may then be joined together with the shoe upper 1 by moving the heat press 31 downwards onto the heel area 4 of the shoe upper 1 to heat press the respective parts in the heel area 4.

In a subsequent step (FIG. 8D, right hand-side), force applying element 36 may engage with the heel area 4 of the shoe upper 1.

This process may further be used to ensure a curved heel area 4. The process of curving the heel area 4 may be understood as a two-step process: in a first step, the heating process, the material used to form the heel area 4 may be made soft and malleable as a result of the applied heat. A subsequent second step, a cold step, may then be applied to fix the final curved shape of the heel area 4.

FIGS. 9A-9D show another exemplary embodiment of the shoe upper 1.

FIG. 9A shows an illustration of an exemplary shoe (comprising the shoe upper 1 formed by the first upper element 38 and the second upper element 37) according to the embodiment as seen from a medial point of view (left hand-side) and as seen from a top-view (right hand-side).

In some cases, the shoe upper 1, according to this embodiment, may be provided such that the bottom face of the second upper element 37, which may be in contact with an asphalt during wearing of the shoe upper 1, may be provided such that no additional (outer) sole is required (left hand-side of FIG. 9A). Alternatively, the shoe may comprise the shoe upper 1 and bottom face 2 attached thereto (right hand-side of FIG. 9A). The former implementation may support a further weight reduction and may thus facilitate a light-weight shoe whereas the latter may provide additional cushioning and thus increased prevention against injuries of the joints of the athlete.

The heel area 4 of the shoe upper 1 is further provided, in the depicted exemplary embodiment, by a heel element 39 which is wrapped around the heel area 4 from a lateral side of the shoe upper 1 to a medial side of the shoe upper 1. The heel area 4 may be used to provide the shoe upper 1 with additional dimensional stability. More specifically, the heel element 39 at least partially fulfill the task of a conventionally used heel counter and may at least contribute to a stiffening of the heel area 4. This may minimize a heel movement during running (in particular, during the phases of landing and push-off) and may thus advantageously contribute to the stability of the foot of the wearer when wearing the shoe (upper). A further side-effect of heel element 39 may be seen in a further weight reduction of the shoe upper (e.g., as compared to a potential usage of a conventional heel counter).

Figure 9B:
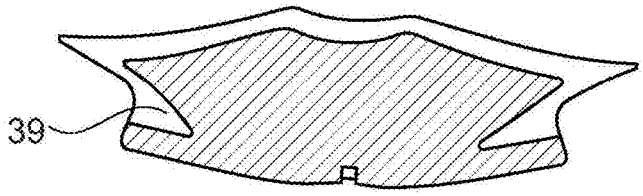
Figure 9C:
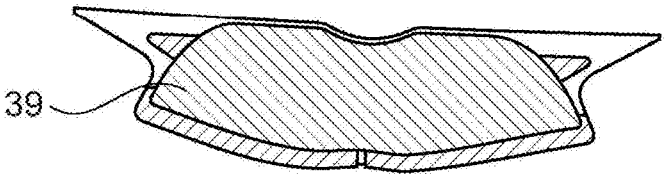

FIGS. 9B and 9C show a detailed view onto the heel element 39 as seen from the front (FIG. 9B) and as seen from the back (FIG. 9C).

Figure 9D:
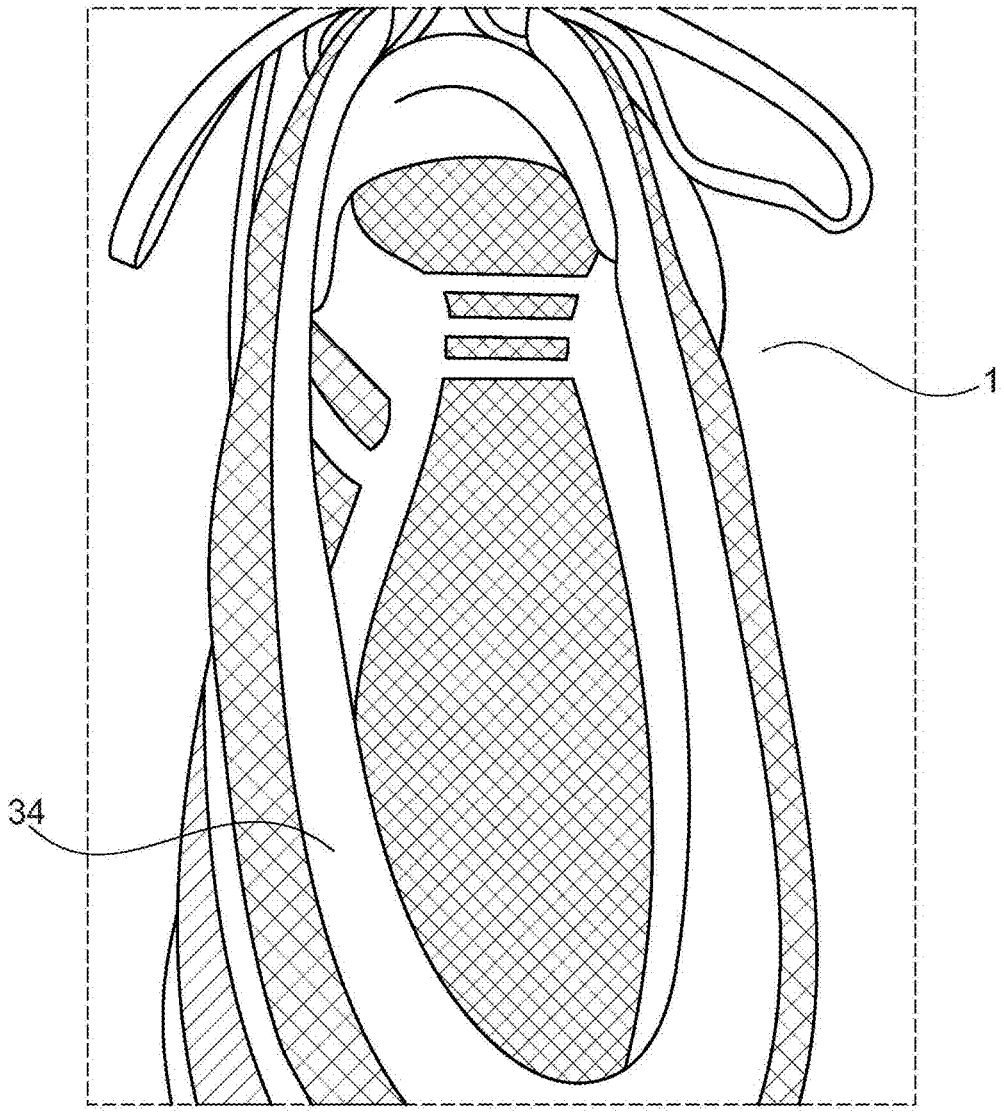

FIG. 9D shows a further illustration of the shoe upper 1 as seen in a skewed elevated view from the heel area 4 of the shoe upper 1. The illustration depicts a view into the throat 34 of the shoe upper 1 towards the toe area 3 of the shoe upper 1.

What is claimed is:

1. A shoe upper, comprising:

first and second upper elements reconfigurable from an uncoupled state to a coupled state such that:

in the uncoupled state, the first and second upper elements are separate parts unattached to each other; and in the coupled state, the first and second upper elements are joined to form a foot-receiving chamber configured for accommodating a foot of a wearer;

wherein the first upper element comprises eyelets adapted to receive a shoelace;

wherein the second upper element forms a footbed;

wherein the second upper element comprises at least a first set of two wings protruding from a lateral side and a medial side of the second upper element, wherein the first set of two wings comprise a first merging area configured to attach the first upper element to the second upper element;

wherein the first set of two wings extend beyond a heel area of the footbed in a longitudinal direction of the second upper element in the uncoupled state; and wherein in the coupled state, the first set of two wings forms the heel area of the shoe upper.

2. The shoe upper of claim 1, wherein the first set of two wings further comprise second merging areas at a lateral outer edge of the first set of two wings extending from a ball area to the heel area.

3. The shoe upper of claim 2, wherein the second upper element further comprises at least a second set of two wings protruding from the lateral side and the medial side of the second upper element.

4. The shoe upper according to claim 3, wherein the second set of two wings is located in a toe area of the shoe upper.

5. The shoe upper of claim 3, wherein the first set of two wings and/or the second set of two wings are integrally formed with the footbed of the second upper element.

6. The shoe upper according to claim 5, wherein the second set of two wings further comprise a third merging area located at an outer edge of the second set of two wings extending laterally from the toe area to the ball area.

7. The shoe upper of claim 6, wherein the first upper element and the second upper element are joined together at the first merging areas and/or at the second merging areas and/or at the third merging areas.

8. The shoe upper of claim 6, wherein at least one wing of the first set of two wings and/or at least one wing of the second set of two wings and/or the second upper element and/or the heel area is provided with at least one reinforcement element adapted to reinforce the respective first merging area and/or the second merging area and/or the third merging area.

9. The shoe upper of claim 8, wherein the at least one reinforcement element is adapted to reinforce the first set of two wings and/or the second set of two wings and/or the second upper element and/or the first merging areas and/or the second merging areas and/or the third merging area and/or the heel area.

10. The shoe upper of claim 8, wherein the at least one reinforcement element is made from a thermoplastic polyurethane (TPU).

11. The shoe upper of claim 6, wherein the first upper element and the second upper element are joined together at least in the first merging area and/or the second merging area and/or the third merging area by stitching and/or by welding.

12. The shoe upper of claim 1, further comprising:

a longitudinal reinforcing element fastened to the first upper element and/or the second upper element extending from the right lateral side of the first upper element and/or the second upper element around the heel area to the left lateral side of the first upper element and/or the second upper element, and wherein the longitudinal reinforcing element is adapted to provide support for the heel area of the foot of the wearer.

13. The shoe upper of claim 12, wherein the longitudinal reinforcing element is connected with the shoe upper by gluing or welding.

14. The shoe upper of claim 1, wherein the first upper element and/or the second upper element is made at least partially from a sandwich mesh.

15. The shoe upper of claim 1, wherein the shoe upper does not have a strobel.

16. The shoe upper of claim 1, wherein the first upper element is additionally reinforced with a mesh element provided in the shape of the first upper element.

17. A shoe, comprising:

the shoe upper of claim 1, wherein a bottom face of the second upper element is adapted to be used as an outer sole of the shoe.

18. A shoe, comprising:

the shoe upper of claim 1.

19. A method for manufacturing a shoe upper of claim 1, comprising the following steps:

providing first and second upper elements, wherein the first upper element comprises eyelets adapted to receive a shoelace, wherein the second upper element comprises at least a first set of two wings protruding from the lateral and medial sides of the second upper element, and wherein each wing comprises a first merging area configured to attach the first upper element to the second upper element, wherein the first set of two wings extend beyond a heel area of the footbed in a longitudinal direction of the second upper element in an uncoupled state; and wherein in a coupled state, the first set of two wings forms the heel area of the shoe upper;

transforming the two wings of the first set of two wings from a planar orientation into a three-dimensional orientation, towards the first upper element; and joining together the first upper element and the second upper element along the transformed two wings, in the first merging area, such that the first upper element and the second upper element are joined together upwards from a ball area of the shoe upper to a heel area of the shoe upper.

* * * * *